US005975785A

United States Patent [19]

Chan

[11] Patent Number: 5,975,785

[45] **Date of Patent: *Nov. 2, 1999**

[54] RING BINDER

[75] Inventor: Keung Chan, Dongguan, China

[73] Assignee: Leco Stationery Manufacturing Company Limited, The Hong Kong Special Administrative Region of the People's Republic of China

[ * ] Notice: This patent is subject to a terminal disclaimer.

[21] Appl. No.: 08/818,722

[22] Filed: Mar. 14, 1997

[30] Foreign Application Priority Data

May 21, 1996 [EP] European Pat. Off. ..... 96303636
Jul. 31, 1996 [EP] European Pat. Off. ..... 96305656

[51] Int. Cl.[6] ..... B42F 3/04
[52] U.S. Cl. ..... 402/36; 402/42
[58] Field of Search ..... 402/36–42

[56] References Cited

U.S. PATENT DOCUMENTS 4,571,108 2/1986 Vogl ..... 402/41
5,346,325 9/1994 Yamanoi et al. .
5,718,529 2/1998 Chan ..... 402/36

FOREIGN PATENT DOCUMENTS 31 19 779 12/1982 Germany .
270400 10/1983 Taiwan .
2 254 828 10/1992 United Kingdom .

*Primary Examiner*—Willmon Fridie, Jr.
*Assistant Examiner*—Mark T. Henderson
*Attorney, Agent, or Firm*—Hall, Priddy & Myers

[57] ABSTRACT

A ring binder comprising a substantially rigid curved upper casing structure supporting a pair of plate, and the plates are pivotally movable between a first position in which the angle between the upper surfaces of the plates is less than 180°, and a second position in which the angle between the upper surfaces of the plates is more than 180°, a lock to lock the pair of plates and triggers or a pair of half-ring members to operate the lock, and the lock acts at a first location on the ring binder and the triggers or pair of half-ring members act at a second location on the ring binder, the first location being longitudinally distal on the ring binder from said second location.

29 Claims, 27 Drawing Sheets

RING BINDER

FIELD OF THE INVENTION

This invention relates to a ring binder and, in particular, a ring binder including a substantially rigid upper structure supporting a pivotable lower structure, to which a number of pairs of half-rings are mounted.

DESCRIPTION OF RELATED ART

Existing ring binders include different kinds of locking mechanisms for preventing accidental opening of the pairs of half-rings, thus allowing paper to fall off the binders. In the absence of a locking mechanism, if the ring binder is in a vertical position, the paper may force the pairs of half-rings to open, thus trapping one or more sheets of paper therebetween. In addition, if there is no proper locking mechanism, in case the ring binder is turned over when holding a large amount of paper, the paper may, by virtue of its weight, force the pairs of half-rings to open.

There are existing ring binders including at either end thereof a lever which is operable to pivot the lower plates to selectively open and/or close pairs of ring members mounted on the plates. Such levers are movable among a first position in which the pairs of ring members are closed and are locked against any force applied thereon, a second position in which the pairs of ring members are closed but may be opened by force applied on any of the pairs of ring members, and a third position in which the pairs of ring members are open.

SUMMARY OF THE INVENTION

According to the present invention, there is provided a ring binder comprising a substantially rigid upper structure supporting a lower structure comprising a pair of plate members, the plate members being pivotally movable between a first position in which the angle between the upper surfaces of the plate members is less than 180°, and a second position in which the angle between the upper surfaces of the plate members is more than 180°, a lock member to lock the lower structure and operating means to operate the lock member, characterized in that the lock member acts at a first location on the ring binder and the operating means acts at a second location on the ring binder, the first location being longitudinally distal on the ring binder from said second location.

Advantageously, at least two pairs of half-ring members may be mounted to the lower structure and said first location may be adjacent a first pair of said half-ring members.

Conveniently, said second location may be adjacent a second pair of said half-ring members.

Suitably, the lock member may be movable from a locked position in which it locks the lower structure against pivotal movement and an unlocked position in which the lower structure is pivotally movable.

The ring binder may advantageously further comprise actuating means indirectly movable by the operating means to move the lock member from the locked position to the unlocked position.

When in the locked position, the lock member may conveniently engage the upper surface of one of the plate members.

When in the unlocked position, at least part of the lock member may suitably extend through aperture means of the lower structure.

Advantageously, at least part of the actuating means may extend through the aperture means.

Conveniently, the actuating means may comprise an end portion inclining at an acute angle to the lower structure when the plate members are on the same plane.

Suitably, a first of the pair of plate members may act on a first side of the actuating means to unlock the lower structure.

A second of the pair of plate members may advantageously act on a second side of the actuating means to lock the lower structure.

The end portion may conveniently be acutely inclined to the longitudinal axis of the ring binder.

The aperture means may suitably comprise at least one edge angled to the longitudinal axis of the ring binder.

Advantageously, the lower structure may act on the end portion during opening of the pairs of half-ring members.

Conveniently, the lower structure may act on the end portion during closing of the pairs of half-ring members.

Suitably, the lock member may be swivellably movable relative the upper structure.

The lock member may advantageously be fixedly engaged with the actuating means.

The lock member may conveniently comprise at least one platelet.

The lock member may suitably comprise a plurality of platelets.

Advantageously, the operating means may comprise at least one of the pairs of half-ring members.

Conveniently, said pair of half-ring members may be adjacent one longitudinal end of the ring binder.

Suitably, the operating means may comprise a plurality of pairs of half-ring members.

The opening means may advantageously comprise two pairs of half-ring members each of which adjacent a respective longitudinal end of the ring binder.

The operating means may conveniently comprise at least one lever member.

The operating means may suitably comprise a plurality of lever members.

Advantageously, the operating means may comprise two lever members each at a respective longitudinal end of the ring binder.

Conveniently, the lever member may be pivotally movable to act on an under surface of the lower structure to move the actuating means to move the lock member from the locked position to the unlocked position.

Suitably, the lower structure may be pivotally movable from its first position to its second position upon pivotal movement of firstly a first of said two lever members and subsequently of a second of said two lever members, and the lower structure is locked against pivotal movement from its first position to its second position upon pivotal movement firstly of the second of said two lever members and subsequently of the first of said two lever members.

The lower structure may advantageously be pivotally movable from its first position to its second position upon pivotal movement of either of the two lever members.

The invention will now be described, by way of examples only, with reference to the accompanying drawings, wherein:

DETAILED DESCRIPTION OF THE INVENTION

As shown in FIGS. 1A to 8, a ring binder according to a first embodiment of the present invention is generally designated as 10. The ring binder 10 includes an upper casing 12 supporting a pair of plates 14*a* and 14*b* to which three pairs of half-rings 16*a*, 16*b* and 16*c* are mounted. The plates 14*a* and 14*b* are pivotally movable relative to each other, so that the pairs of half-rings 16*a*, 16*b* and 16*c* may be selectively opened (when the angle between the upper surfaces of the plates 14*a* and 14*b* is more than 180°) or closed (when the angle between the upper surfaces of the plates 14*a* and 14*b* is less than 180°). The half-rings 16*a*, 16*b* and 16*c* extend through three pairs of slots 18*a*, 18*b* and 18*c* on the upper casing 12, which allow the half-rings 16*a*, 16*b* and 16*c* to open or close. At each end of the ring binder 10 is a hole 20*a* and 20*b*, through which a rivet (not shown) may be received to secure the ring binder 10 to an article (not shown), e.g. a paperboard/plastic/metal cover.

Figure 1A:
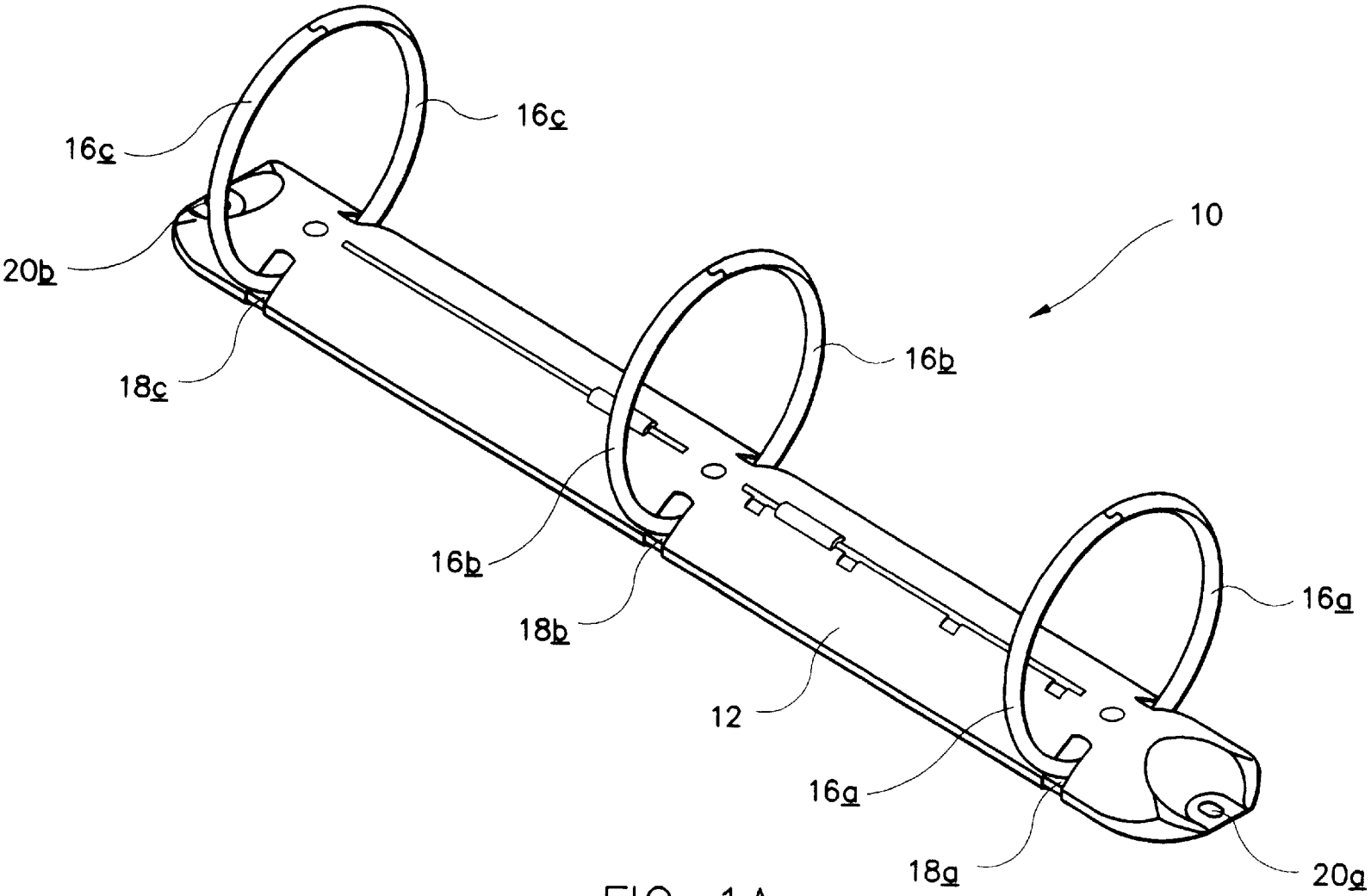
FIG. 1A shows a top perspective view of a first embodiment of a ring binder according to the present invention with the half-rings in a closed position.
Figure 1B:
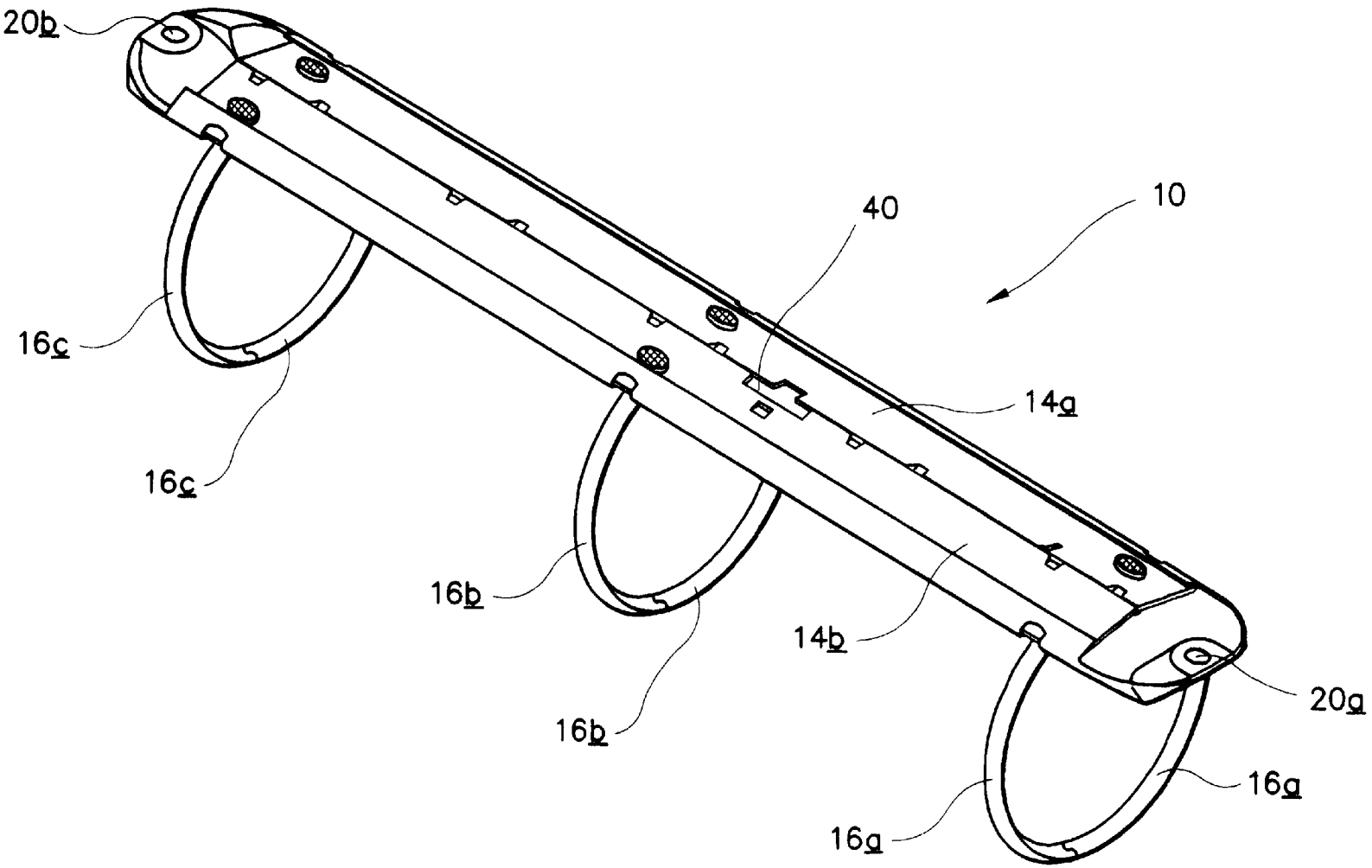
FIG. 1B shows a bottom perspective view of the ring binder shown in FIG. 1A.
Figure 2:
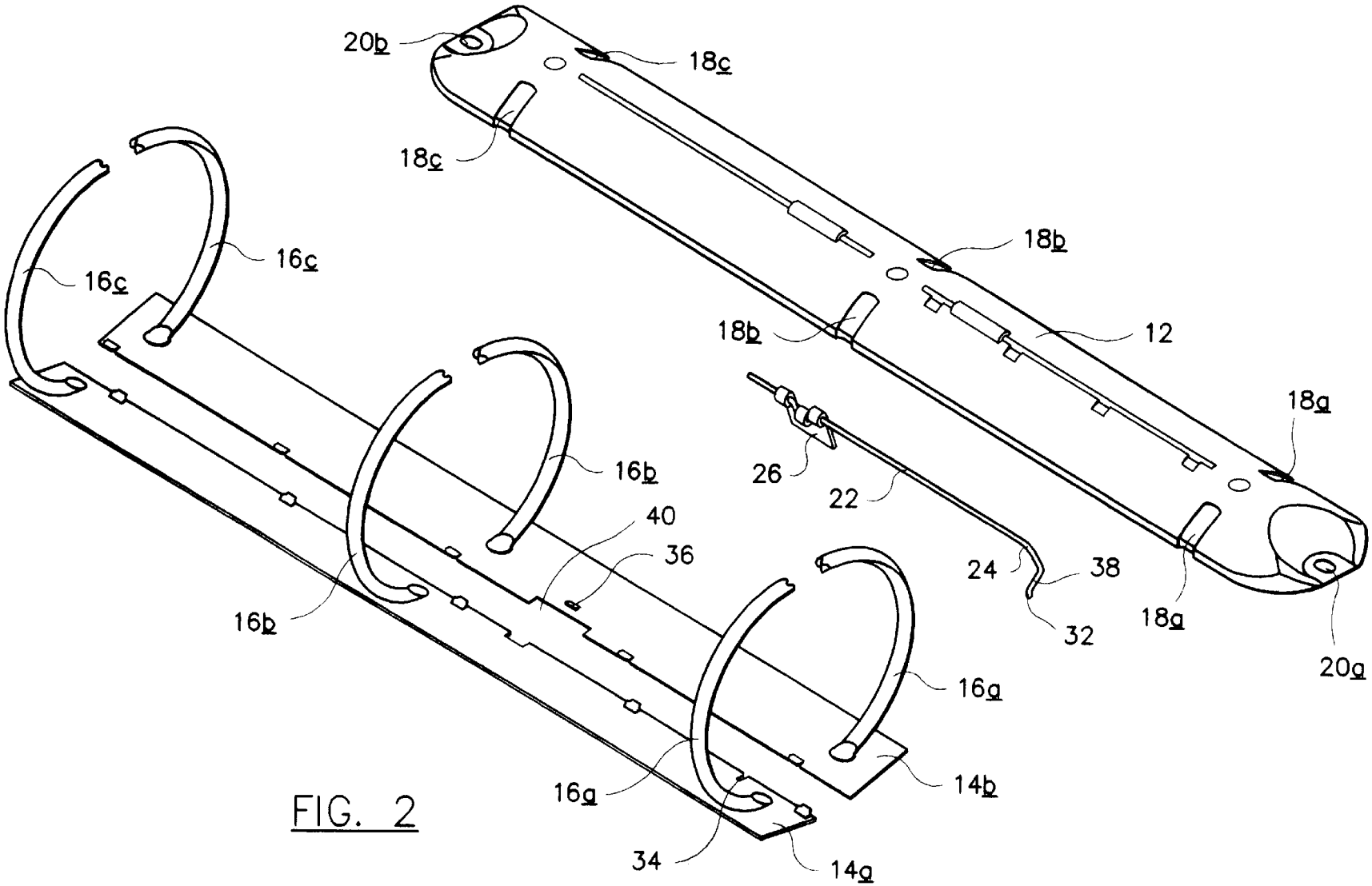
FIG. 2 shows an exploded view of the ring binder shown in FIG. 1A.
Figure 3:
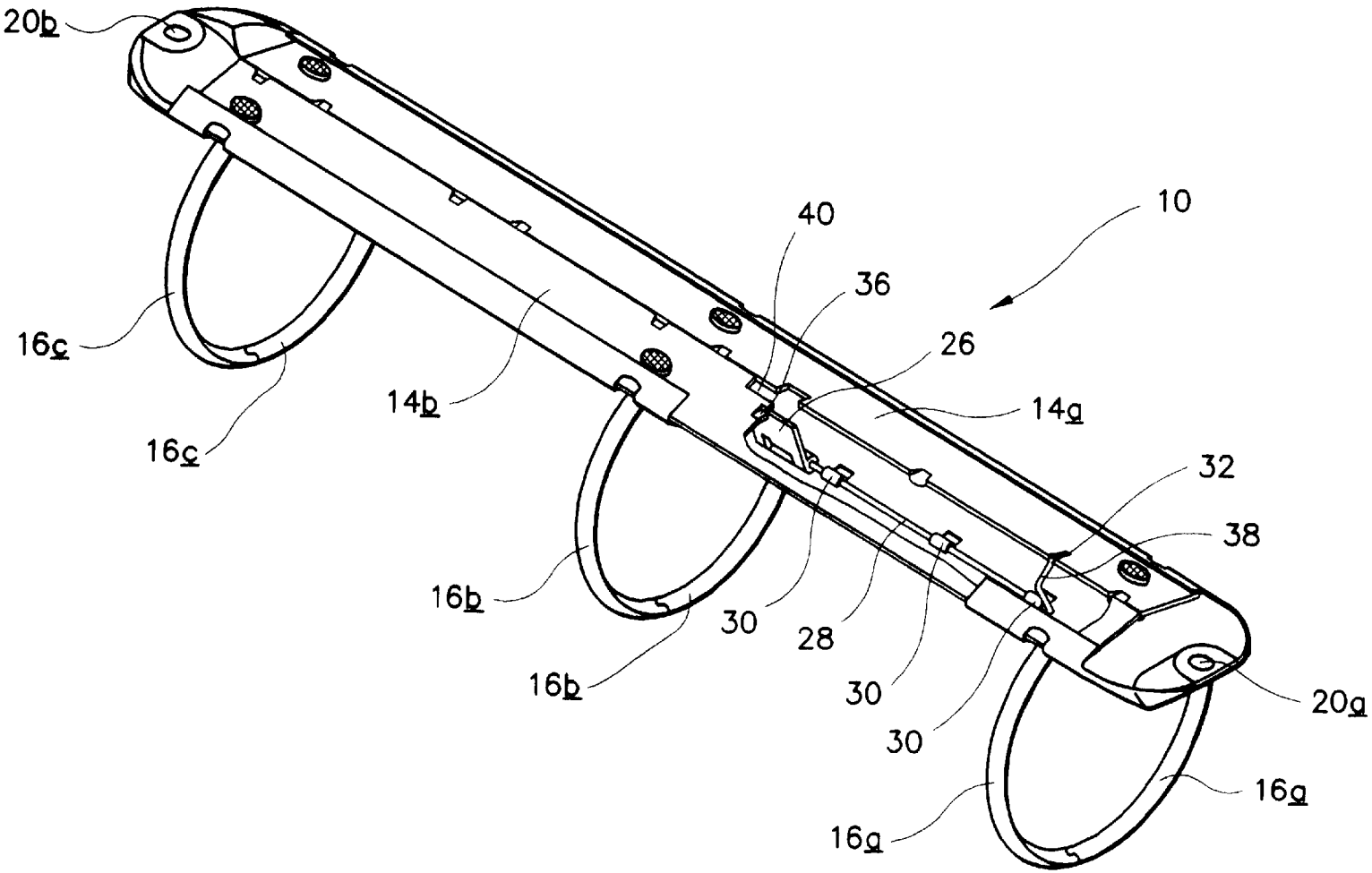
FIG. 3 shows a bottom perspective view of the ring binder shown in FIG. 1A, with part of the lower structure removed for clarity purposes.
Figure 4:
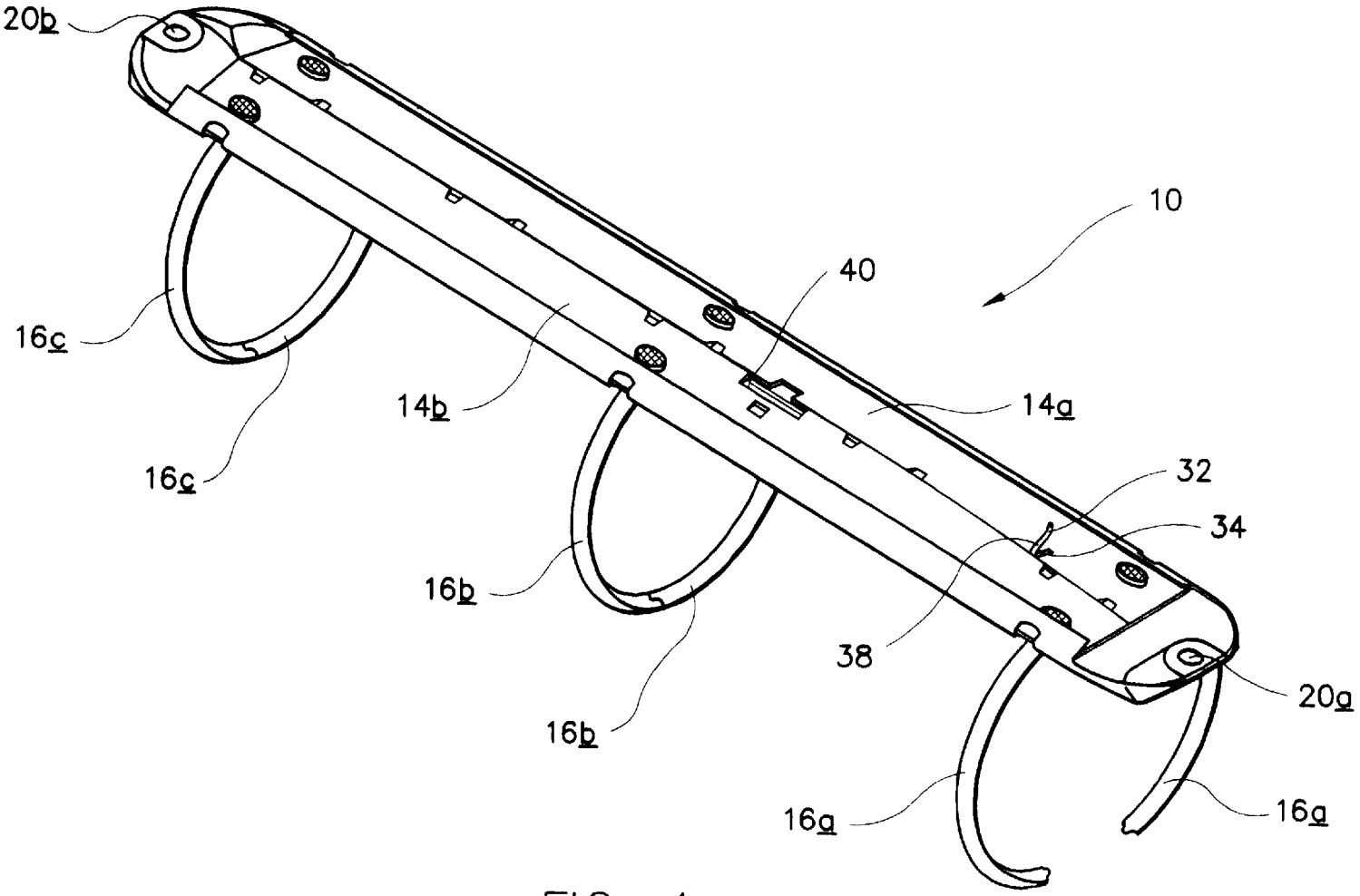
FIG. 4 shows the ring binder of FIG. 1A with its lower structure in a partly moved position.
Figure 5:
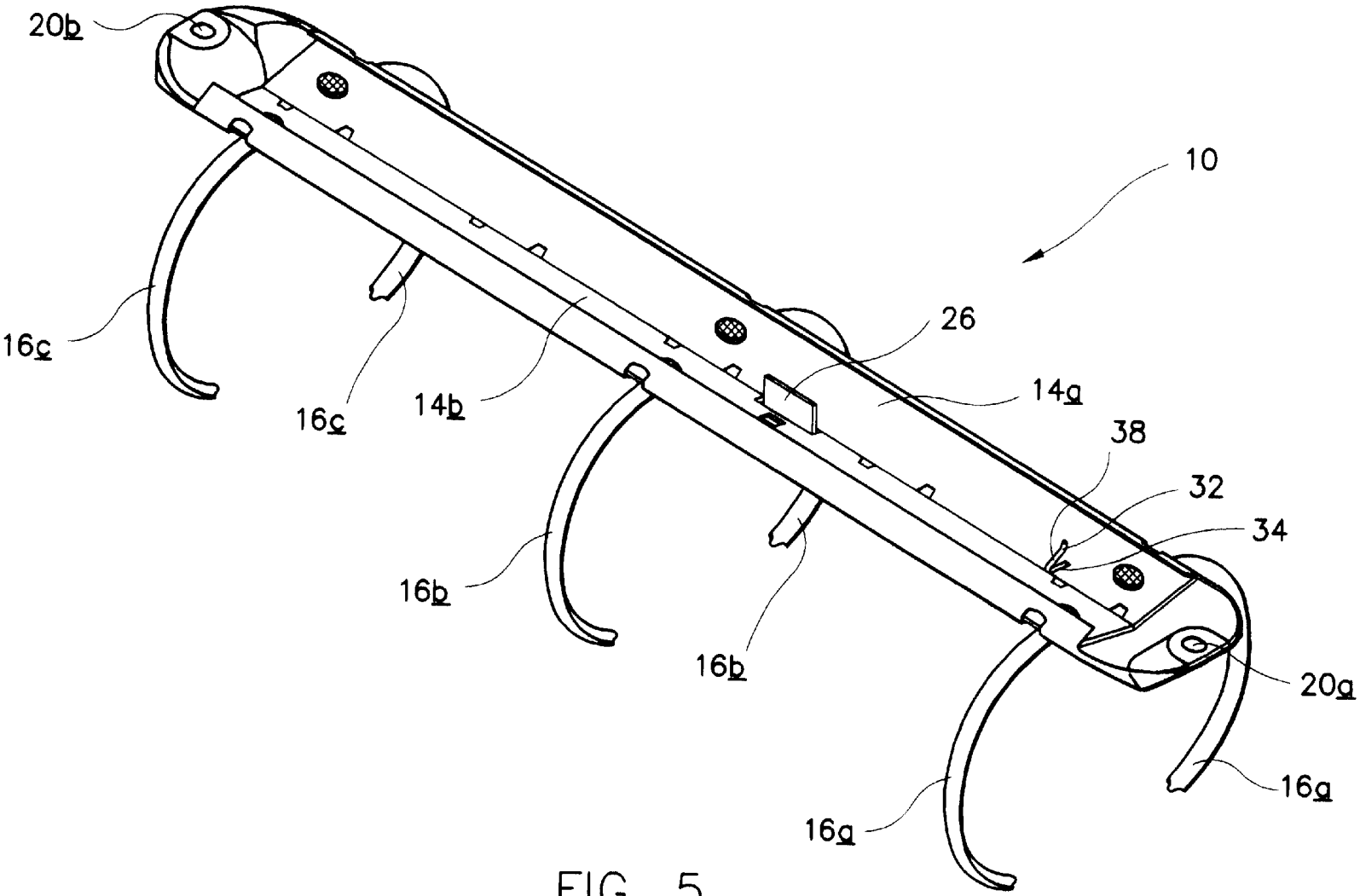
FIG. 5 shows the ring binder of FIG. 1A with the half-rings in an open position.

As shown more clearly in FIG. 2, the ring binder 10 includes a lock 22 including a wire 24 with a lock element 26 fixedly crimped thereon. As shown in FIG. 3, the wire 24 includes a shaft 28 which is secured to the middle line of lower surface of the upper casing 12 by three inturned parts 30 crimped therewith. The lock 22 is thus supported by the upper casing 12 between the half-rings 16*a* and 16*b*. The lock 22, the wire 24 and the lock element 26 are thus allowed to swivel about the longitudinal axis of the shaft 28.

As shown more clearly in FIGS. 6A to 7B, the lock 22 is partly received in a channel 29 on the underside of the upper casing 12. A corresponding ridge 31 is thus formed on the upper side of the upper casing 12. This arrangement also enhances the strength of the upper casing 12, and thus the ring binder 10.

In the position when all the half-rings 16*a*, 16*b* and 16*c* are closed, as shown in FIG. 1A, 1B, 3, 6A and 6B, a distal end 32 of the wire 24 extends slightly through an aperture 34 of the plate 14*a*. In this position, the lock element 26 abuts against both the upper surface of the plate 14*b* and a tongue 36. Any attempt to open the half-rings 16*a*, 16*b* and 16*c* by applying force to half-rings 16*b* or 16*c* will not be successful as the plate 14*b*, and consequently the plate 14*a*, is prevented from exhibiting any upward pivoting movement by reason of the lock element 26 acting against the plate 14*b*.

Figure 6B:
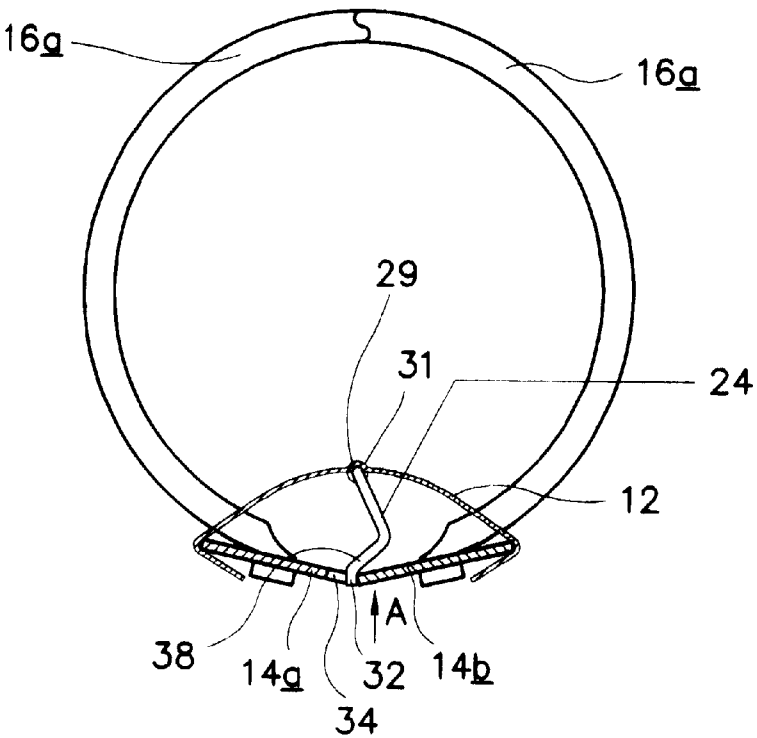
FIG. 6B shows a transverse sectional view of the ring binder shown in FIG. 1A across the key member with the half-rings in the closed position.
Figure 6A:
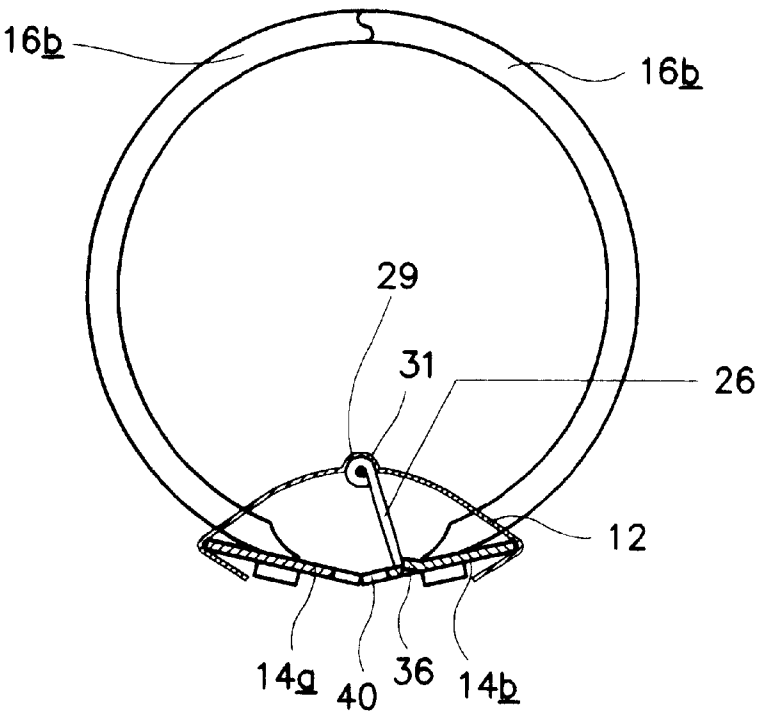
FIG. 6A shows a transverse sectional view of the ring binder shown in FIG. 1A across the lock member with the half-rings in the closed position.
Figure 7B:
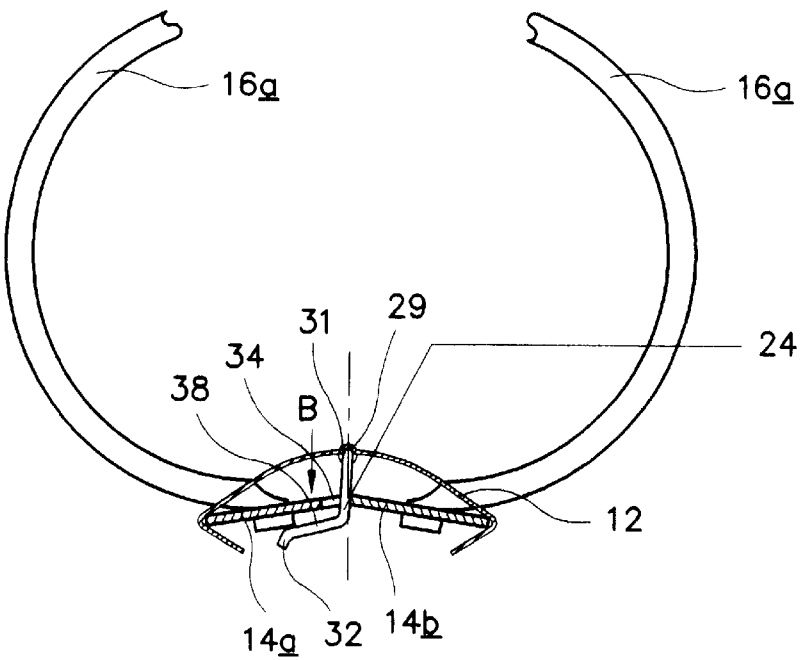
FIG. 7B shows a transverse sectional view of the ring binder shown in FIG. 1A across the key member with the half-rings in the open position.
Figure 7A:
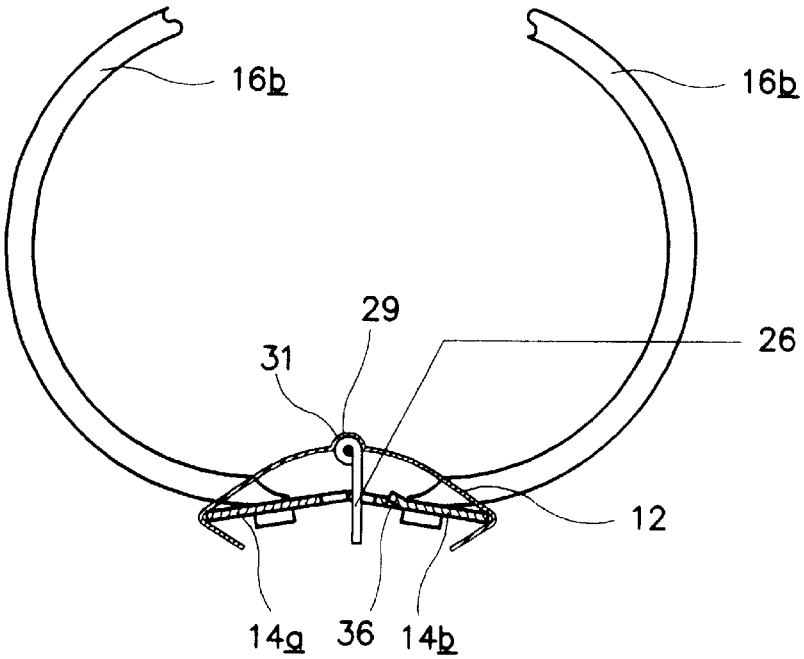
FIG. 7A shows a transverse sectional view of the ring binder shown in FIG. 1A across the lock member with the half-rings in the open position.

On the other hand, and as shown in FIGS. 6A and 6B, if a pulling force is applied on the half-rings 16*a*, the plate 14*b* will act upon a bent portion 38 of the wire 24 in the direction shown by an arrow A. This will cause the lock 22 to rotate about the shaft 28 in a clockwise direction (according to FIGS. 6A and 6B) to the position shown in FIG. 4. In this position, the wire 24 extends further through the aperture 34 of the plate 14*a*, and the lock element 26 is moved away from the upper surface of the plate 14*b* and the tongue 36, and aligns with an opening 40 of the plate 14*b*. Further pivoting movement of the plates 14*a* and 14*b*, and thus opening of all the half-rings 16*a*, 16*b* and 16*c*, are thus made possible by further pulling action on the half-rings 16*a*.

Figure 8:
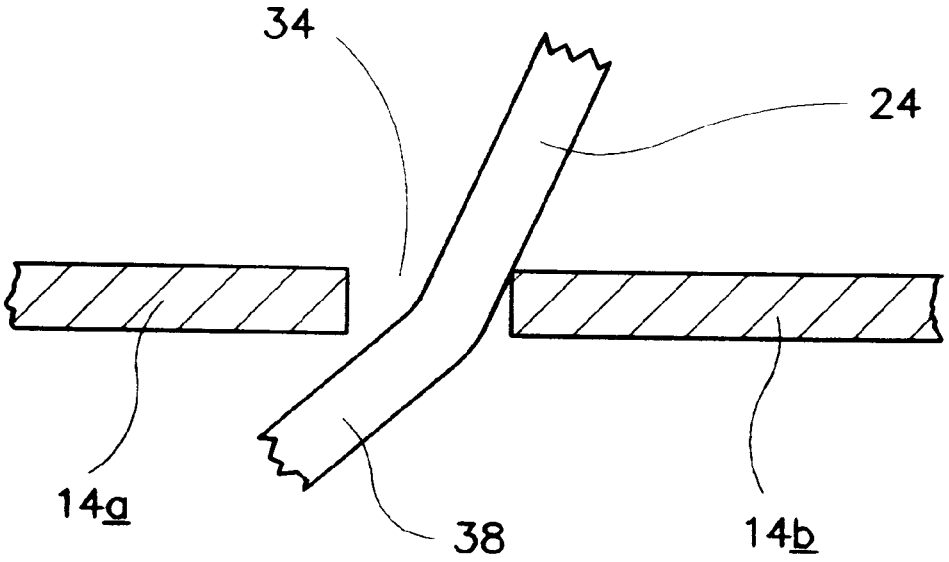
FIG. 8 shows a partial transverse sectional view of the ring binder shown in FIG. 1A across the key member with the plates on the same plane.
Figure 9:
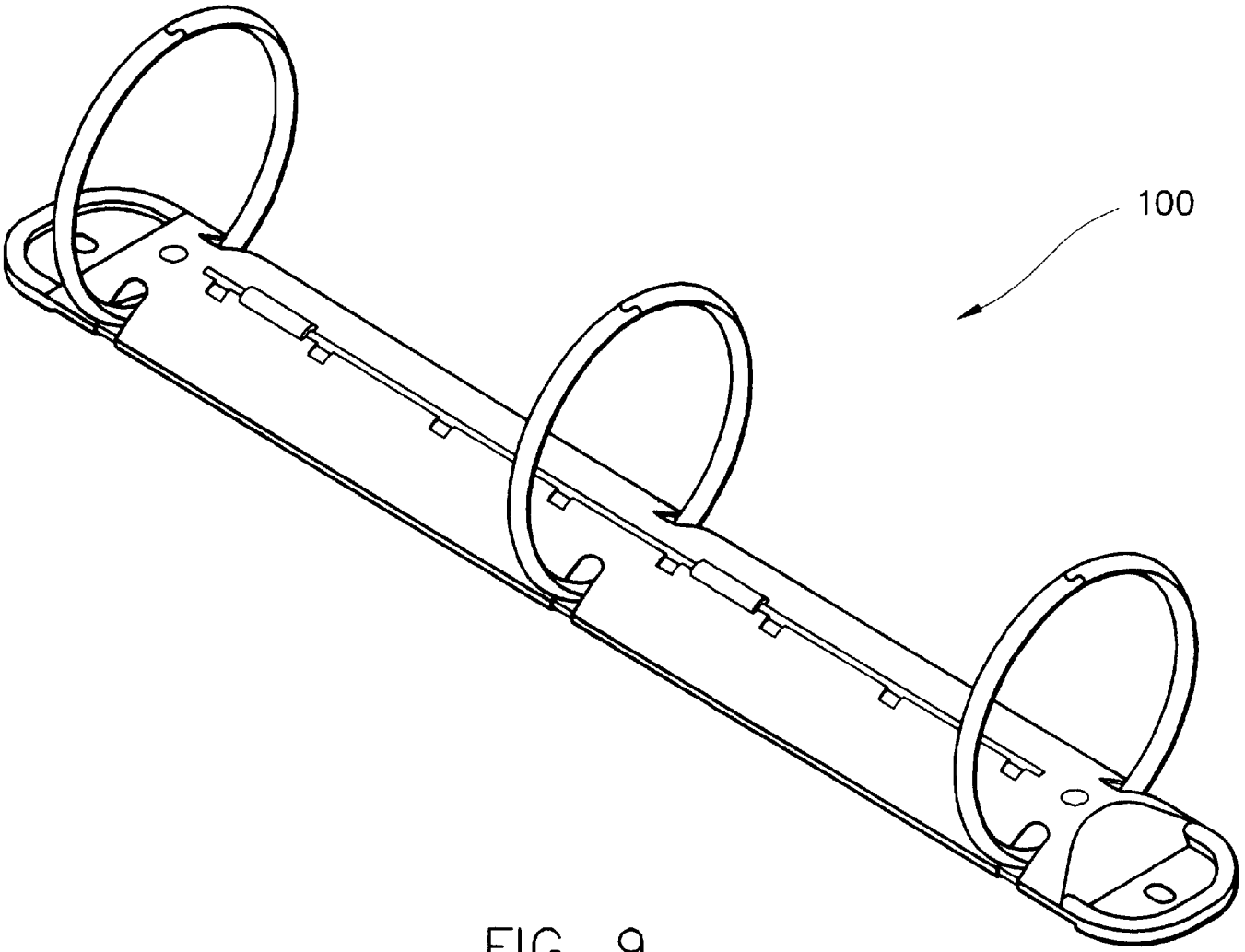
FIG. 9 shows a top perspective view of a second embodiment of a ring binder according to the present invention with the half-rings in a closed position.
Figure 10:
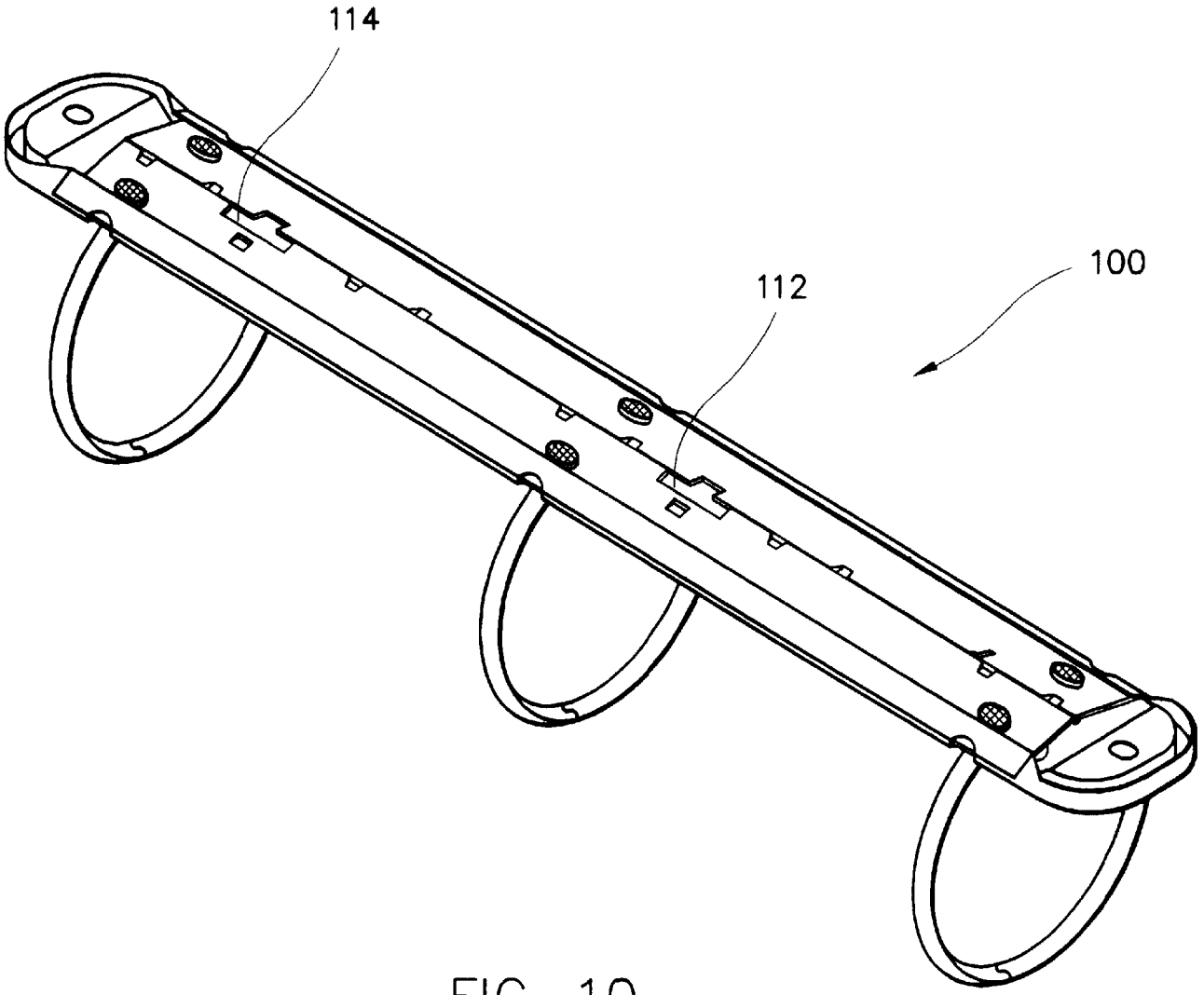
FIG. 10 shows a bottom perspective view of the ring binder shown in FIG. 9.
Figure 11:
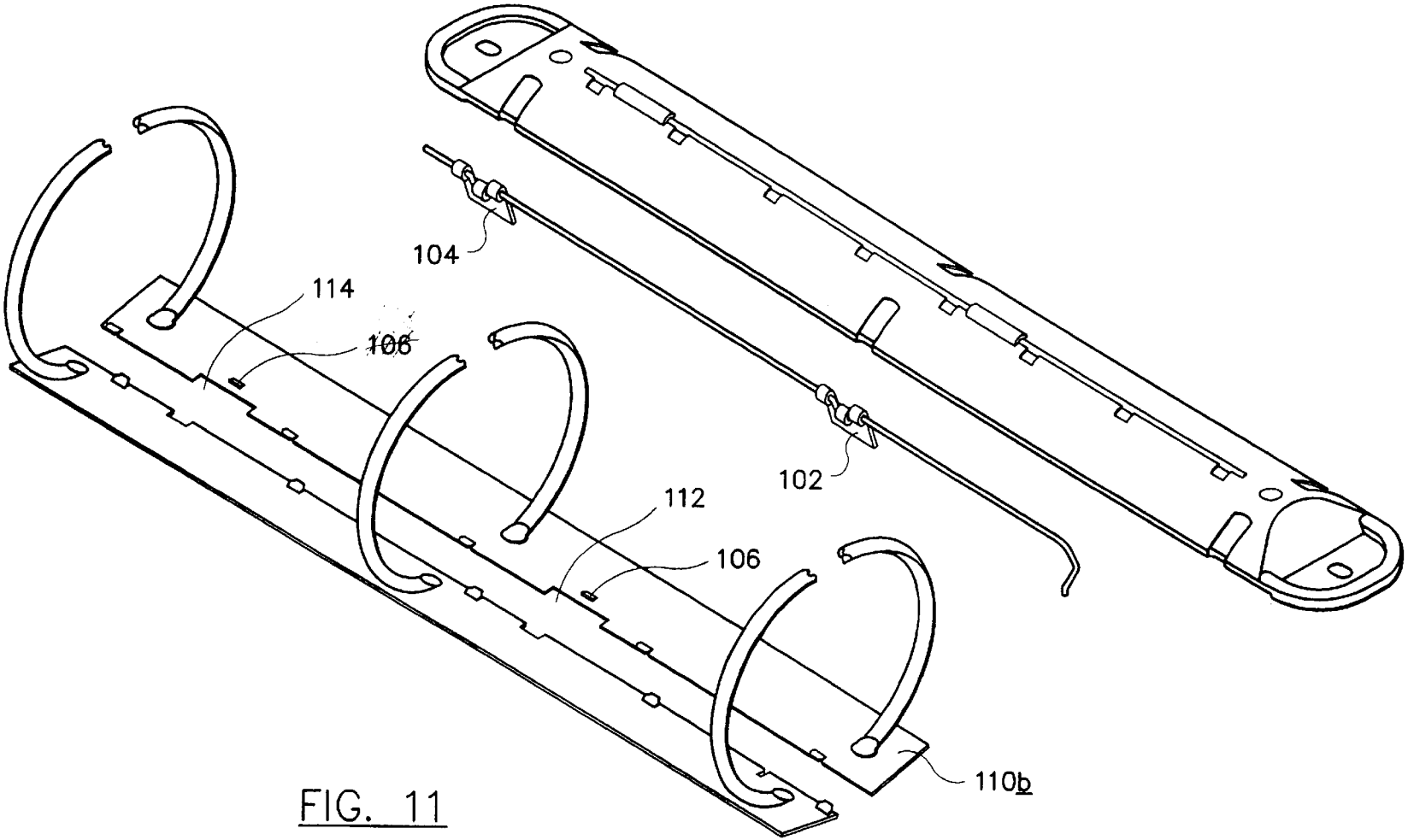
FIG. 11 shows an exploded view of the ring binder shown in FIG. 9.
Figure 12:
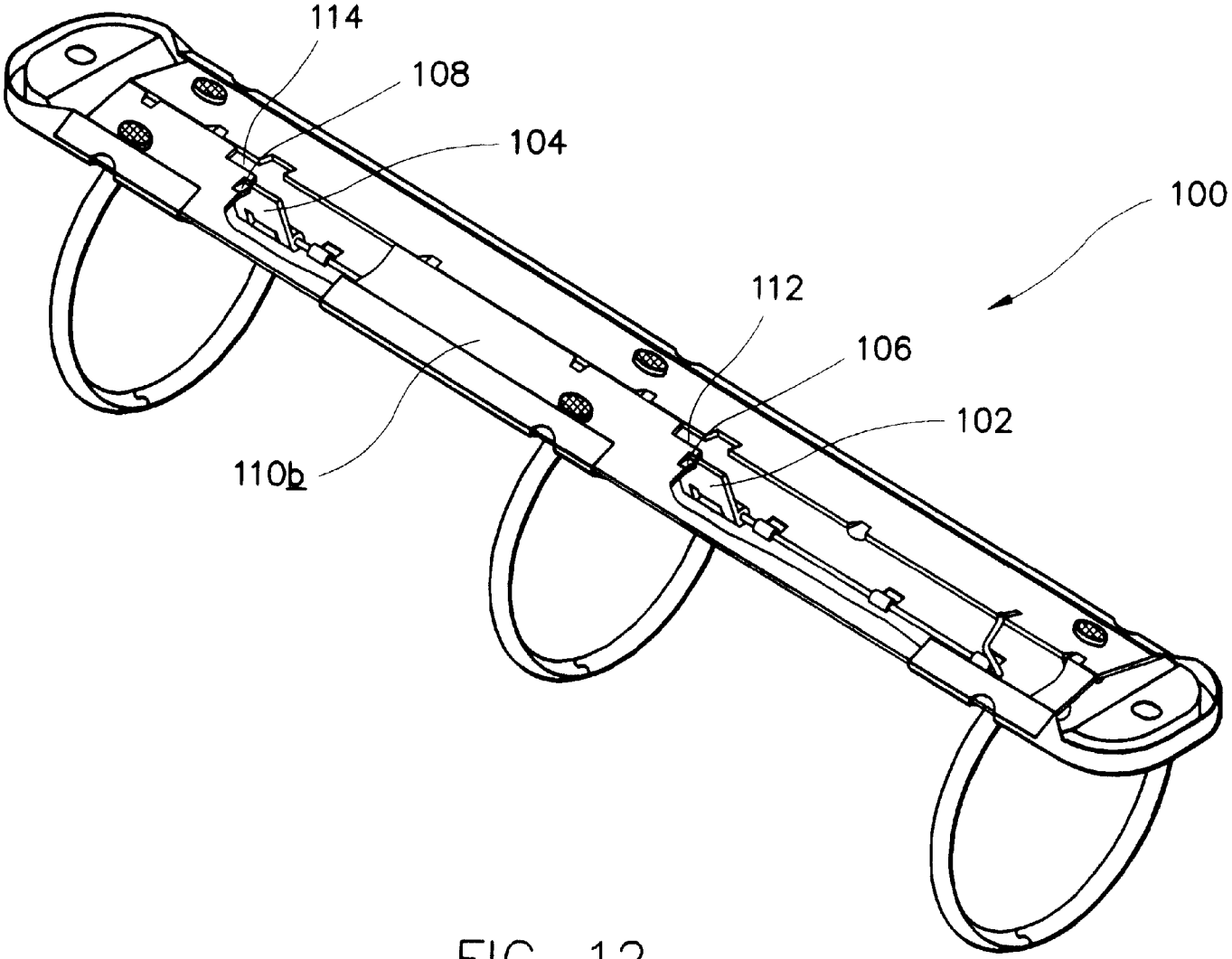
FIG. 12 shows a bottom perspective view of the ring binder shown in FIG. 9, with part of the lower structure removed for clarity purposes.
Figure 13:
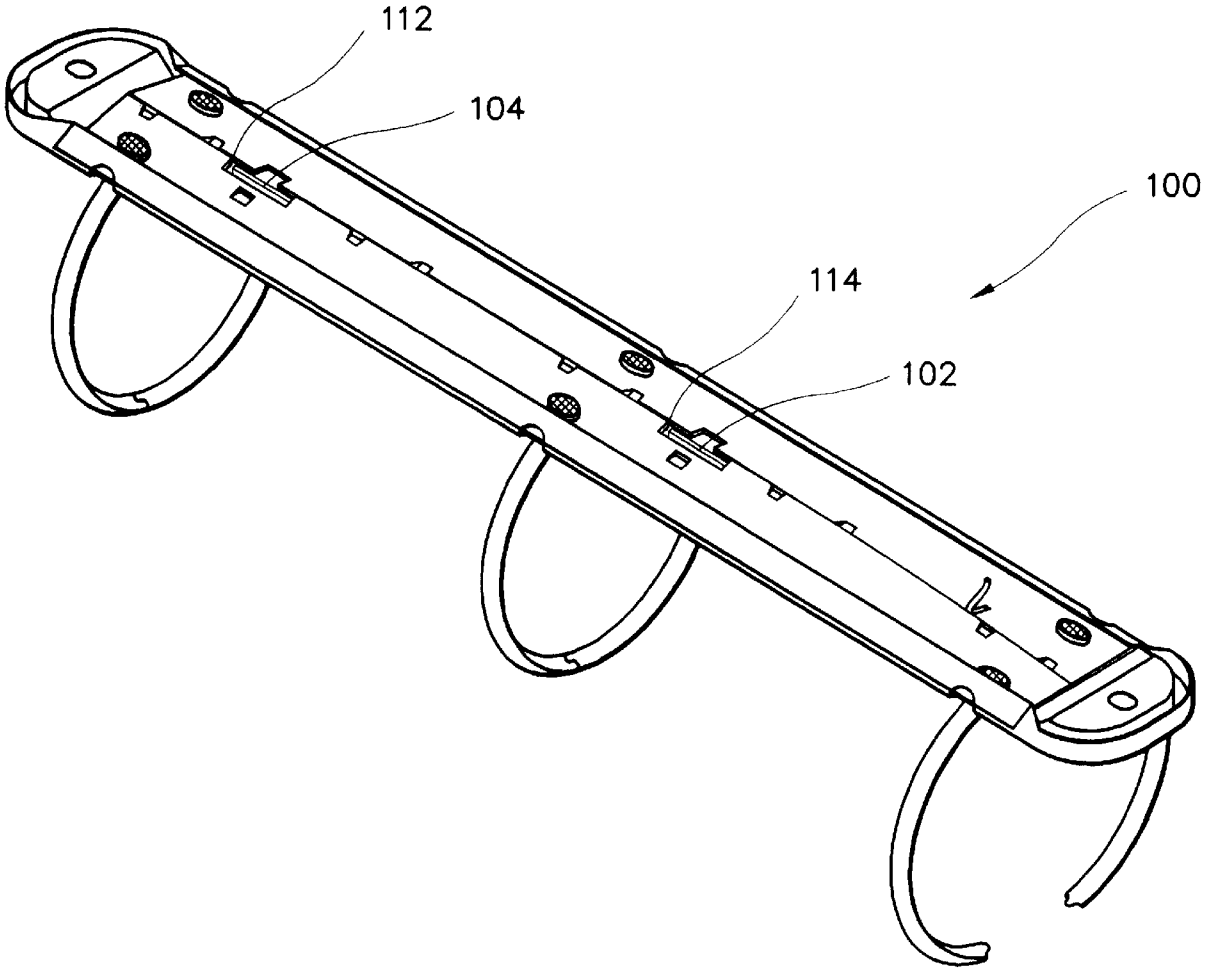
FIG. 13 shows the ring binder of FIG. 9 with its lower structure in a partly moved position.
Figure 14:
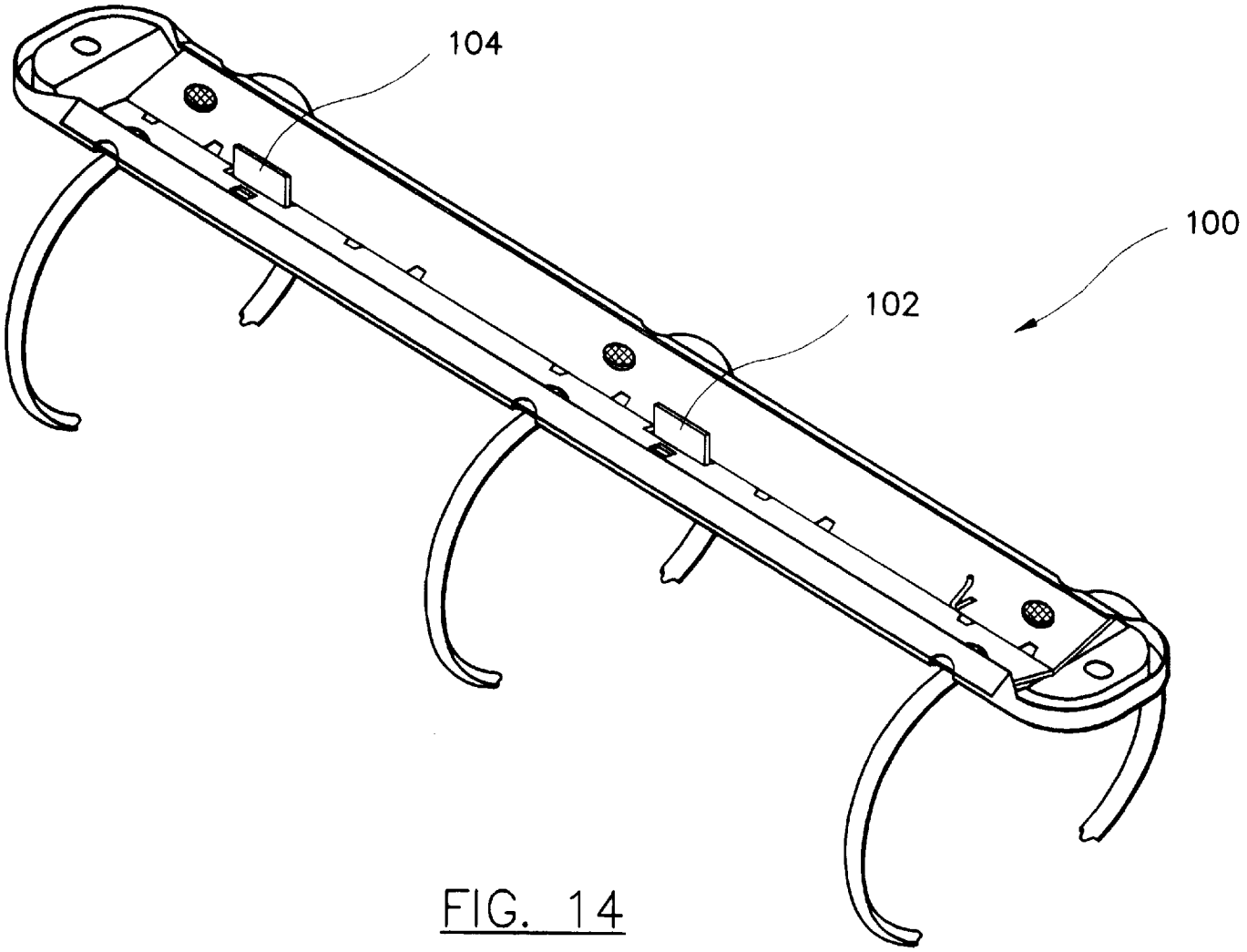
FIG. 14 shows the ring binder of FIG. 9 with the half-rings in an open position.

The half-rings 16*a*, 16*b* and 16*c* may be returned to the closed position by pushing together any one of the three pairs of half-rings 16*a*, 16*b* and 16*c*. When a pushing force is applied on any of the three pairs of half-rings 16*a*, 16*b* and 16*c*, the plate 14*a* will act from above on the bent portion 38 of the wire 24, as shown by an arrow B in FIG. 7B, so that the lock 22 is caused to rotate about the shaft 28 in an anti-clockwise direction (according to FIG. 7B) to the position shown in FIG. 6B. As shown in FIG. 8, when the plates 14*a* and 14*b* are on the same plane, the bent portion 38 of the wire 24 inclines at an acute angle to the plane containing the plates 14*a* and 14*b*. There is sufficient space in the aperture 34 for the bent portion 38 to pass through during closing and opening of the half-rings 16*a*, 16*b* and 16*c*. To further enhance this action, the bent portion 38 of the wire 24 may be acutely angled to the longitudinal axis of the ring binder 10. The effectiveness of this action can be still further enhanced by arranging a side of the aperture 34 to be angled to the longitudinal axis of the ring binder 10.

The extent of return movement of the lock element 26 to its locked position is governed by the tongue 36, which prevents excessive movement of the lock element 26. This also prevents the distal end 32 of the wire 24 from being hidden in the cavity formed by the upper casing 12 and the plates 14*a* and 14*b*.

It is clear from the foregoing discussion that, in the present invention, only one pair of half-rings, namely 16*a*, can be actioned upon to cause the plates 14*a* and 14*b* to pivot, and thereby to open all the half-rings 16*a*, 16*b* and 16*c*. The ring binder 10 is thus locked from any opening movement unless this specific pair of half-rings are actioned upon. In addition, it can be seen that the pair of half-rings 16*a* and the lock element 26 act on different longitudinal locations of the plates 14*a* and 14*b* of the ring binder 10. On the other hand, all the half-rings 16*a*, 16*b* and 16*c* can be actioned upon to close the ring binder 10.

FIGS. 9 to 14 show a second embodiment of a ring binder according to the present invention generally designated as 100. The major difference of this embodiment from the first embodiment discussed above is the provision of two lock elements 102 and 104. Consequently, two tongues 106 and 108 are provided on the upper surface of a plate 110*b* to govern the movements of the lock elements 102 and 104 back to the locked position, and two openings 112 and 114 are provided on the plate 110*b* for allowing part of the lock elements 102 and 104 to pass through.

Figure 15:
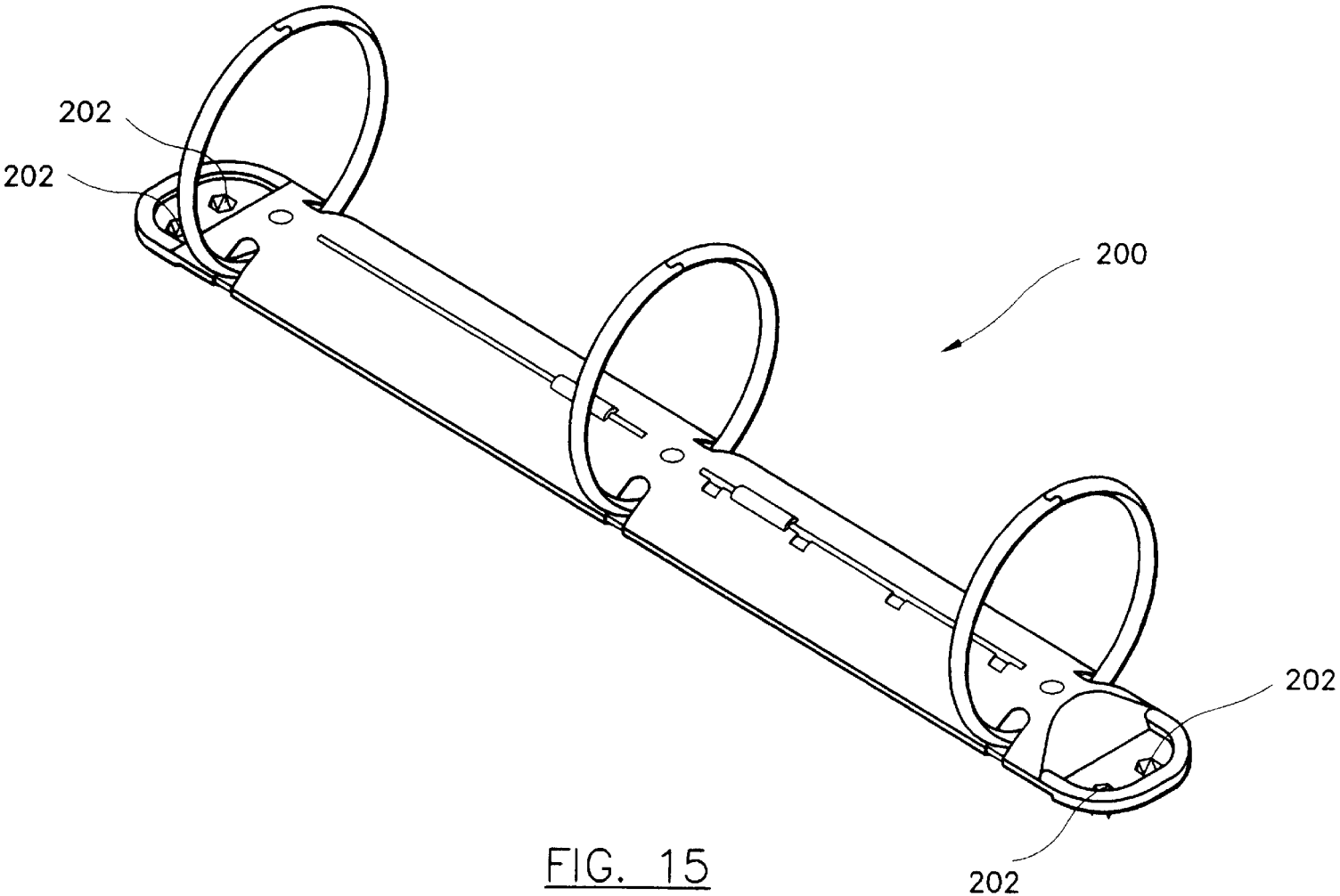
FIG. 15 shows a top perspective view of a third embodiment of a ring binder according to the present invention with the half-rings in a closed position.
Figure 16:
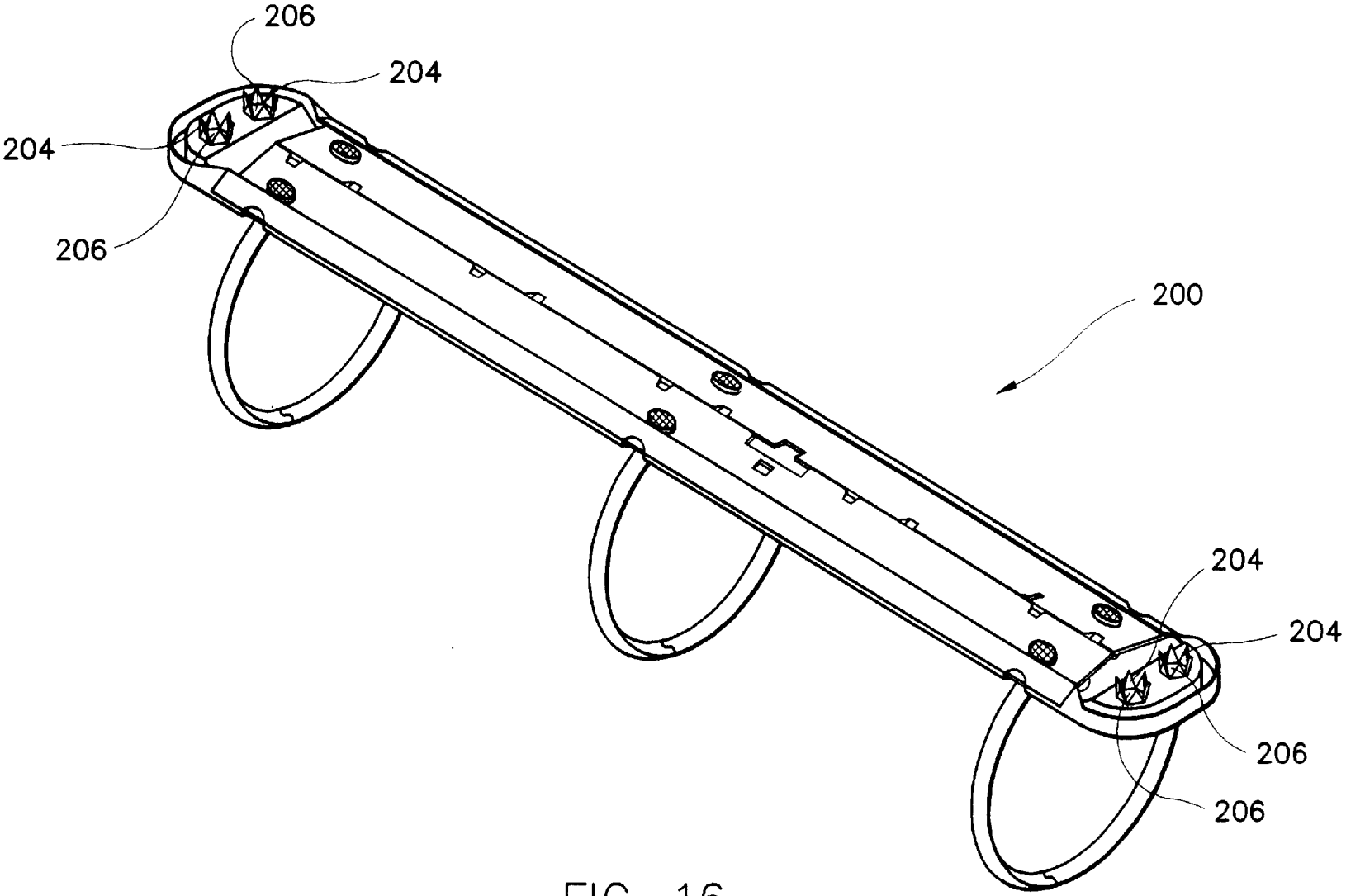
FIG. 16 shows a bottom perspective view of the ring binder shown in FIG. 15.
Figure 17:
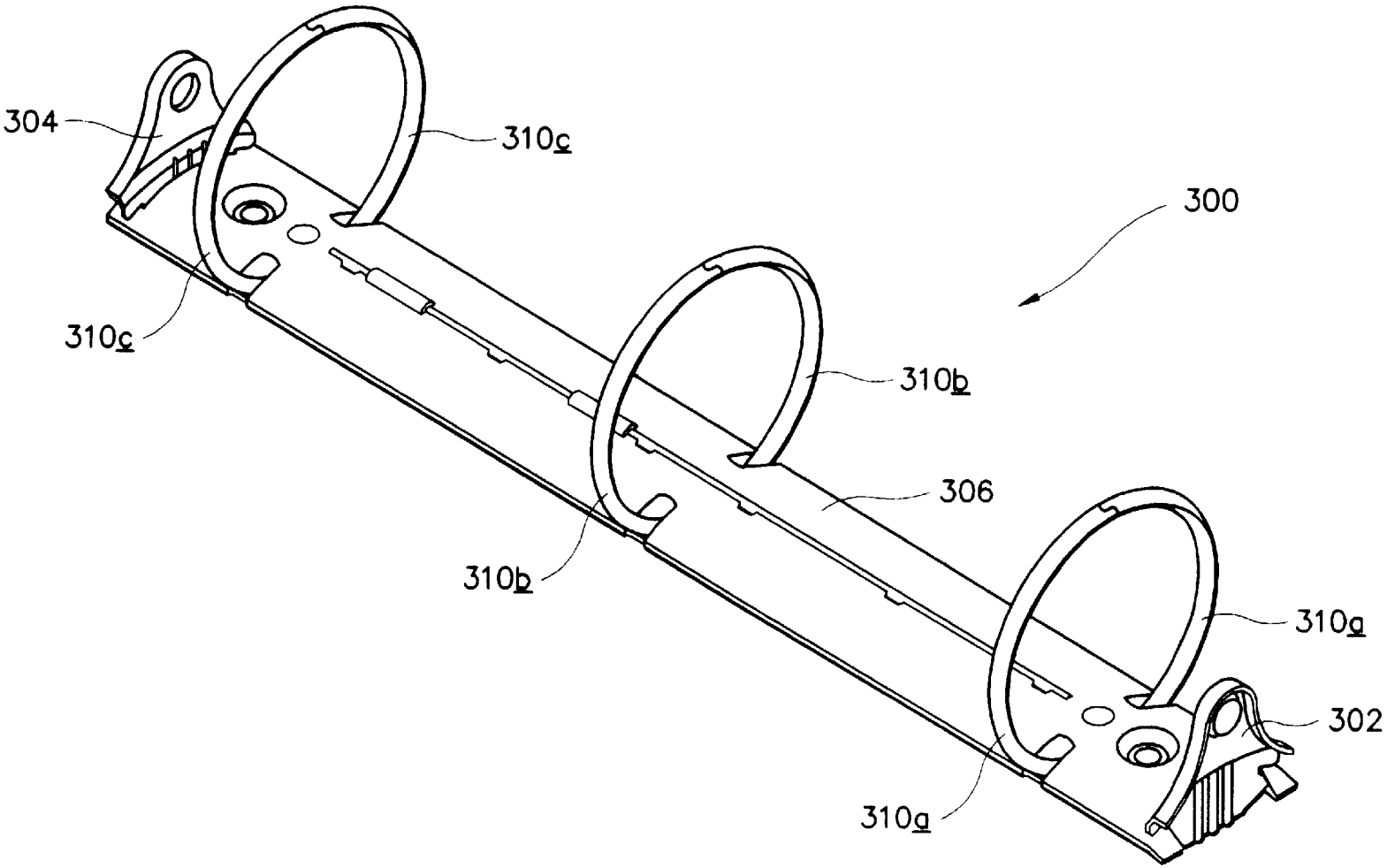
FIG. 17 shows a top perspective view of a fourth embodiment of a ring binder according to the present invention with the half-rings in a closed position.

FIGS. 15 and 16 show a third embodiment of a ring binder according to the present invention generally designated as 200. The major difference of this embodiment from the first embodiment discussed above is the provision of two securing members 202 at each end of the ring binder 200. Each securing member 202 includes six arcuate pointed sectors 204 downwardly depending from the periphery of an orifice 206. It is thus possible to secure the ring binder 200 to a cardboard/paperboard cover without using any rivet.

FIGS. 17 to 21 show a fourth embodiment of a ring binder according to the present invention generally designated as 300. The ring binder 300 includes two levers 302 and 304, each at one end of the ring binder 300. The ring binder 300 also includes an upper casing 306 supporting a pair of plates 308*a* and 308*b* to which three pairs of half-rings 310*a*, 310*b* and 310*c* are mounted. The plates 308*a* and 308*b* are pivotally movable relative to each other, so that the pairs of half-rings 310*a*, 310*b* and 310*c* may be selectively opened or closed. Each of the levers 302 and 304 includes a ledge 312 and 314 respectively. When the levers 302 and 304 are pivoted outwardly, the ledges 312 and 314 act on bottom surfaces of the plates 308*a* and 308*b*.

Figure 19:
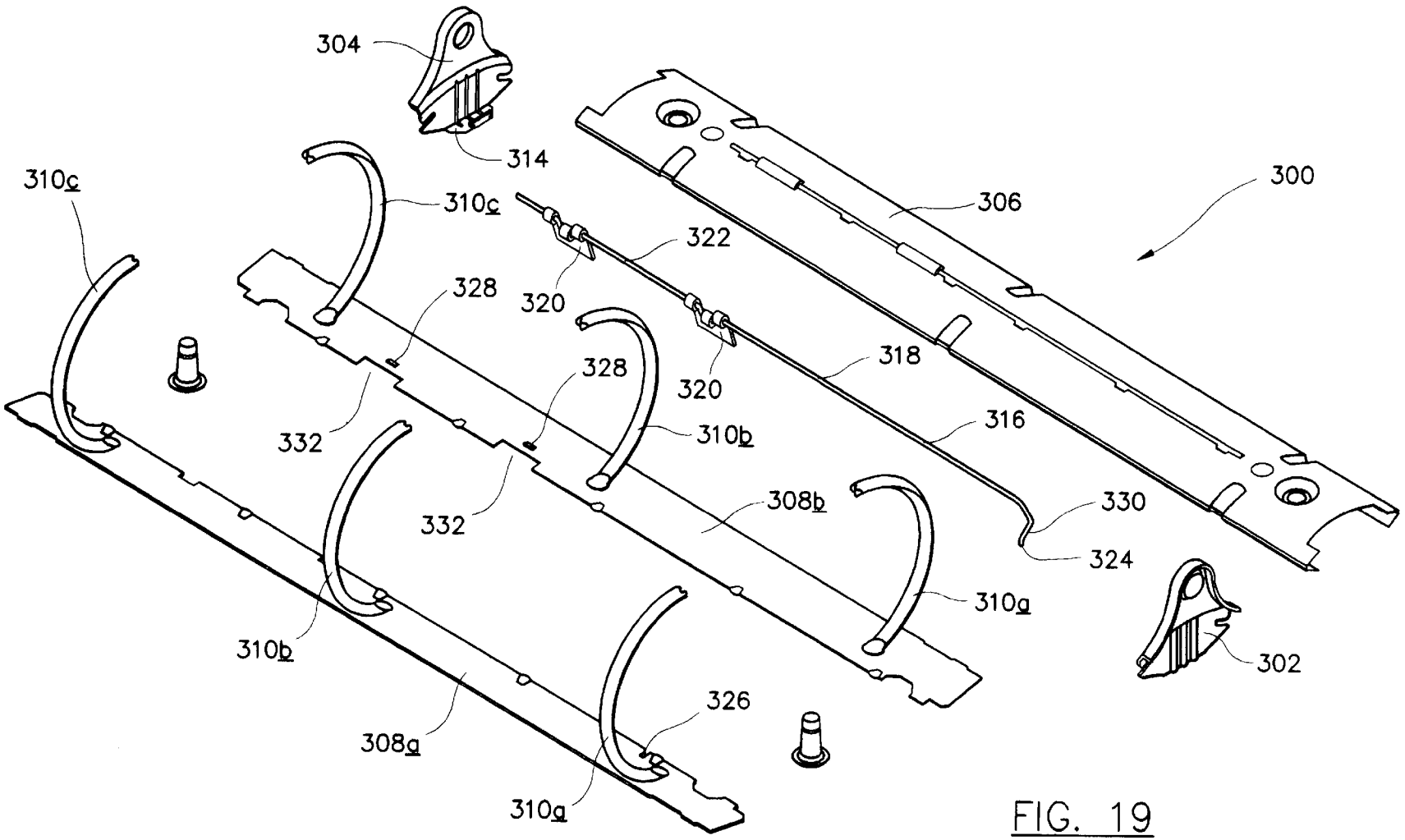
FIG. 19 shows an exploded view of the ring binder shown in FIG. 17.

As can be seen in FIG. 19, the ring binder 300 includes a lock 316 including a wire 318 with two lock elements 320 fixedly crimped thereon. As in the three embodiments discussed above, the lock 316 includes a shaft 322 which is secured to the lower surface of the upper casing 306. The lock 316 is thus supported by the upper casing 306 and may swivel about the longitudinal axis of the shaft 322.

Figure 18:
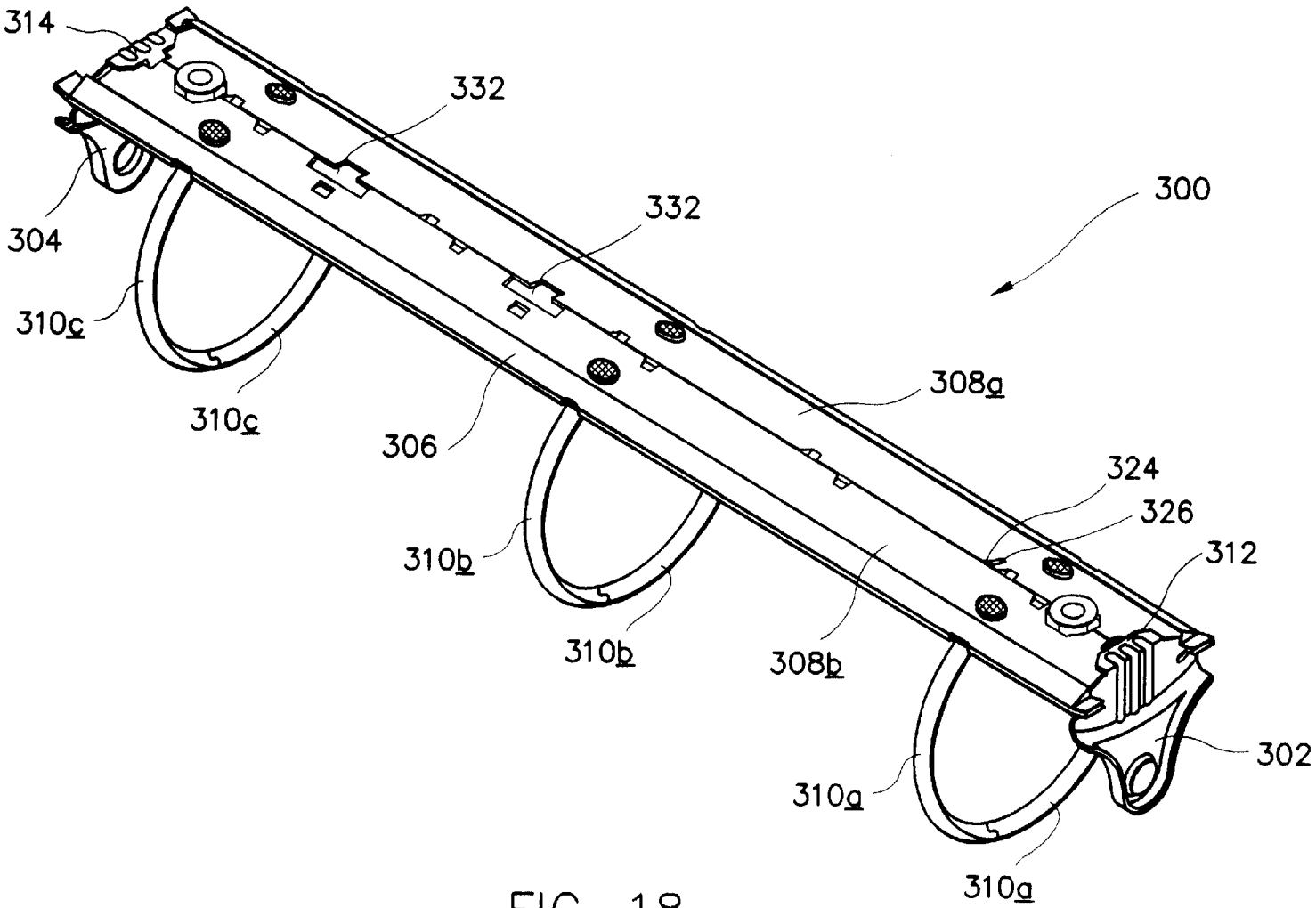
FIG. 18 shows a bottom perspective view of the ring binder shown in FIG. 17.

When all the half-rings 310*a*, 310*b* and 310*c* are closed, as shown in FIG. 18, a distal end 324 of the wire 318 extends slightly through an aperture 326 of the plate 308*a*. In this position, the lock elements 320 abut against the upper surface of the plate 308*b* and tongues 328.

Figure 20:
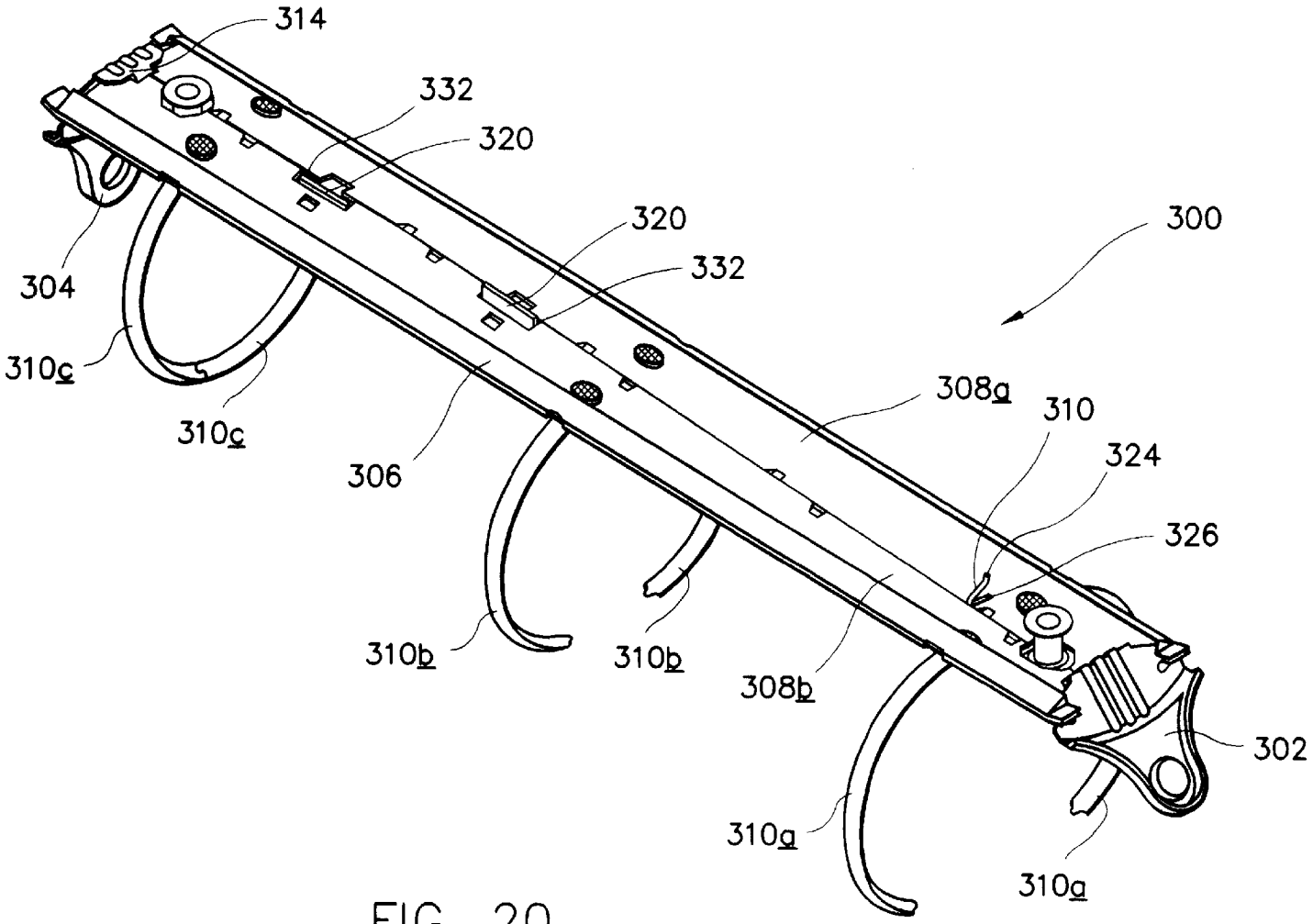
FIG. 20 shows a bottom perspective view of the ring binder shown in FIG. 17 with some of the half-rings partly opened.
Figure 21:
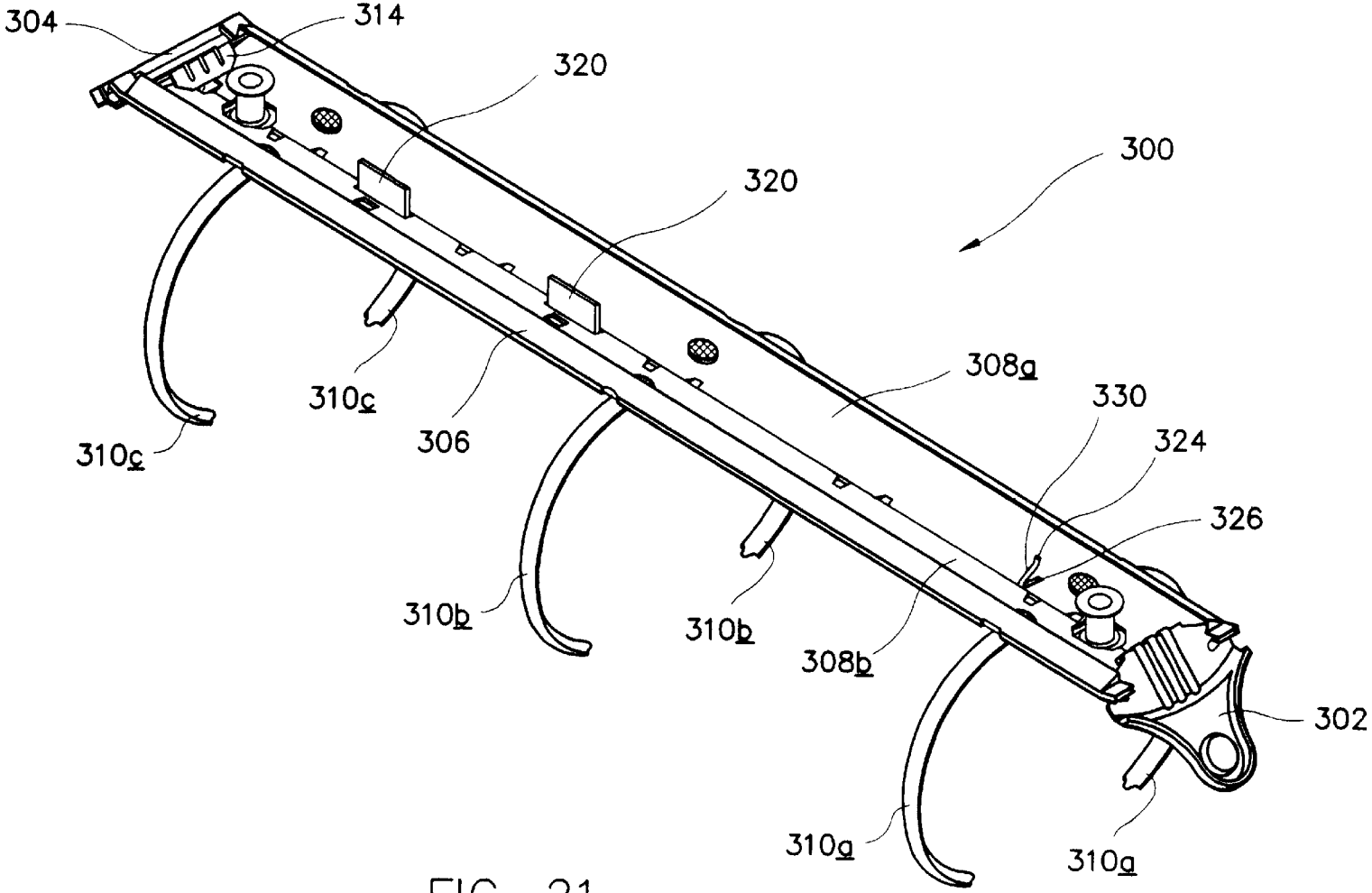
FIG. 21 shows a bottom perspective view of the ring binder shown in FIG. 17 with all the half-rings fully opened.
Figure 22:
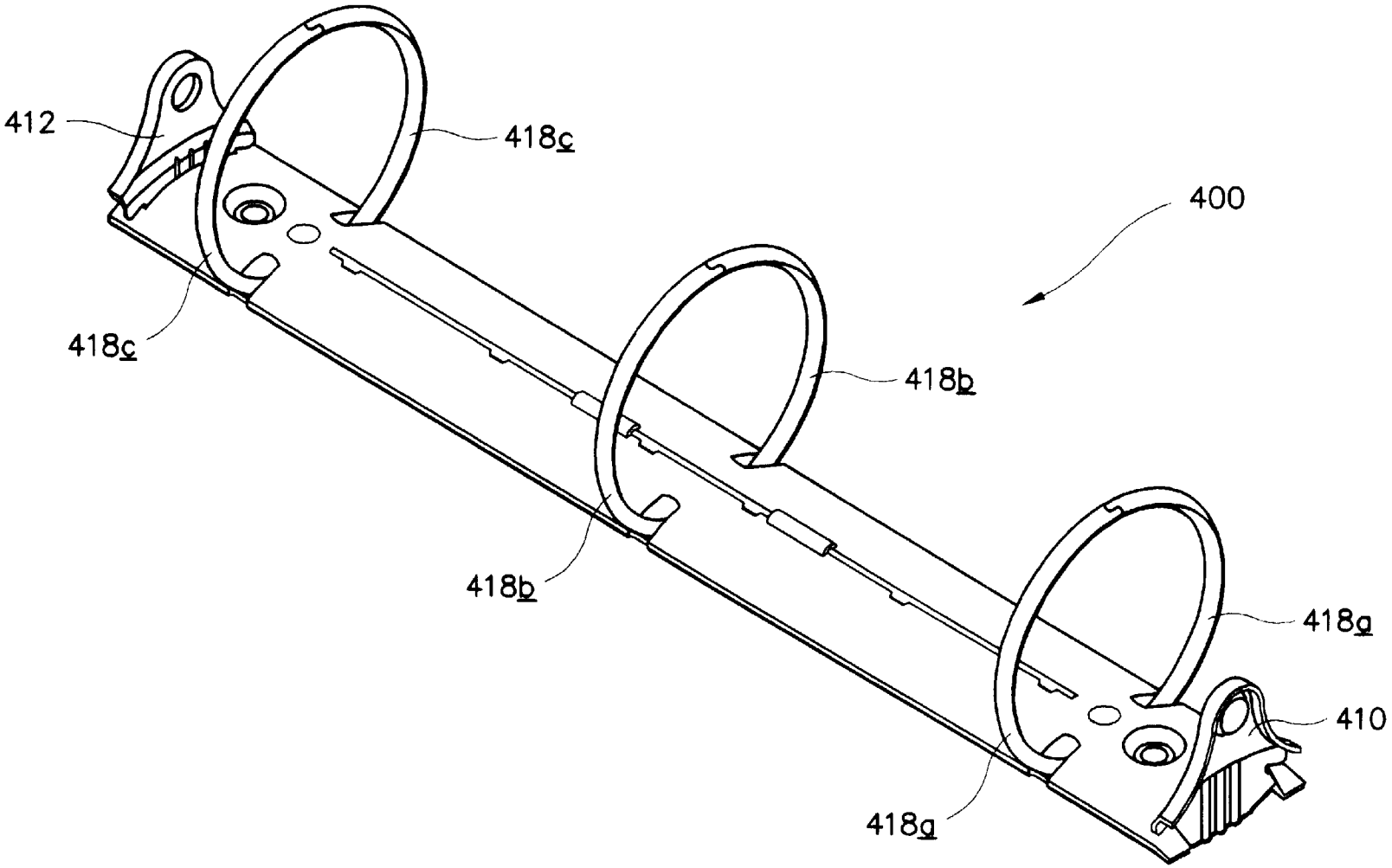
FIG. 22 shows a top perspective view of a fifth embodiment of a ring binder according to the present invention with the half-rings in a closed position.
Figure 23:
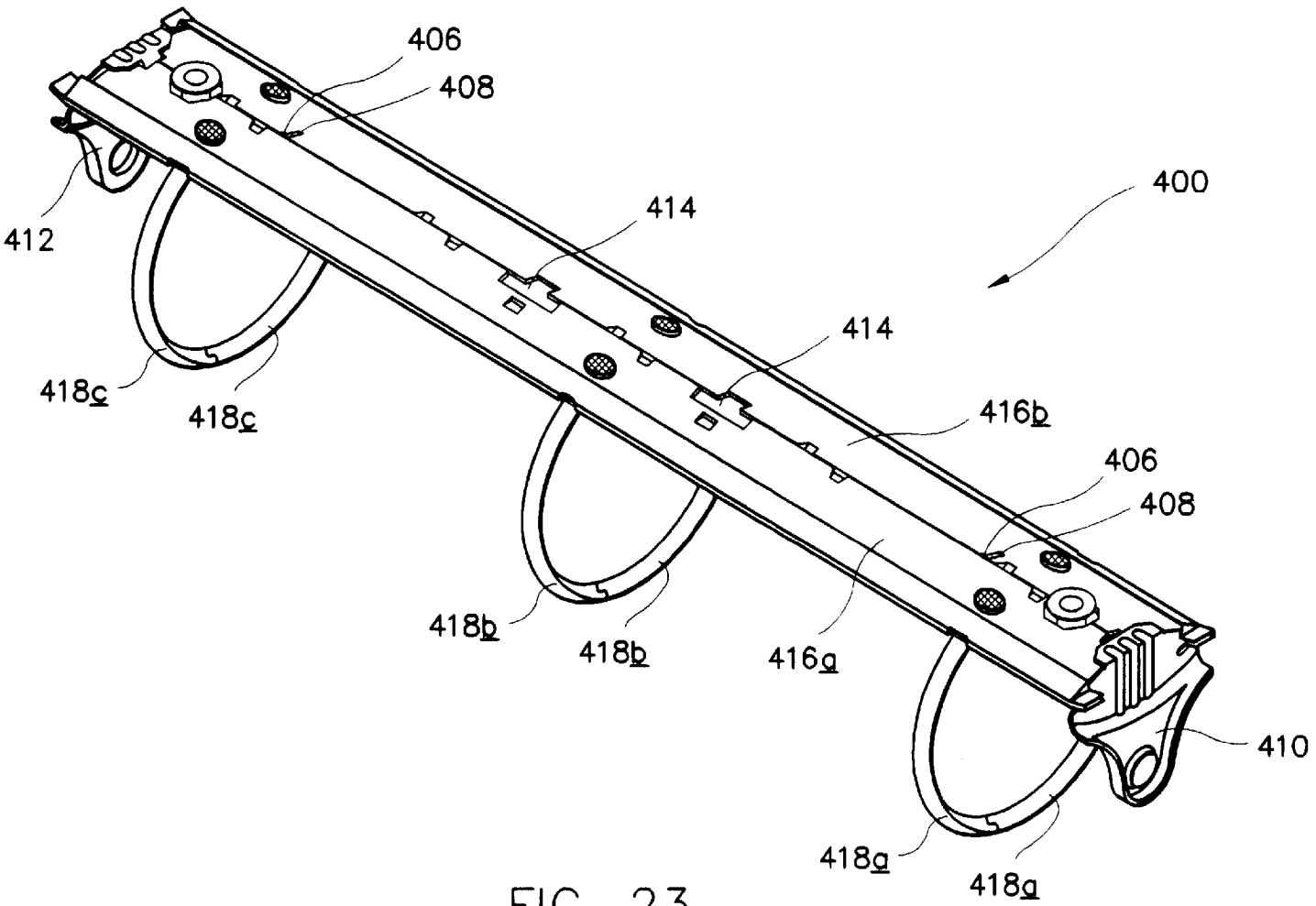
FIG. 23 shows a bottom perspective view of the ring binder shown in FIG. 22.
Figure 24:
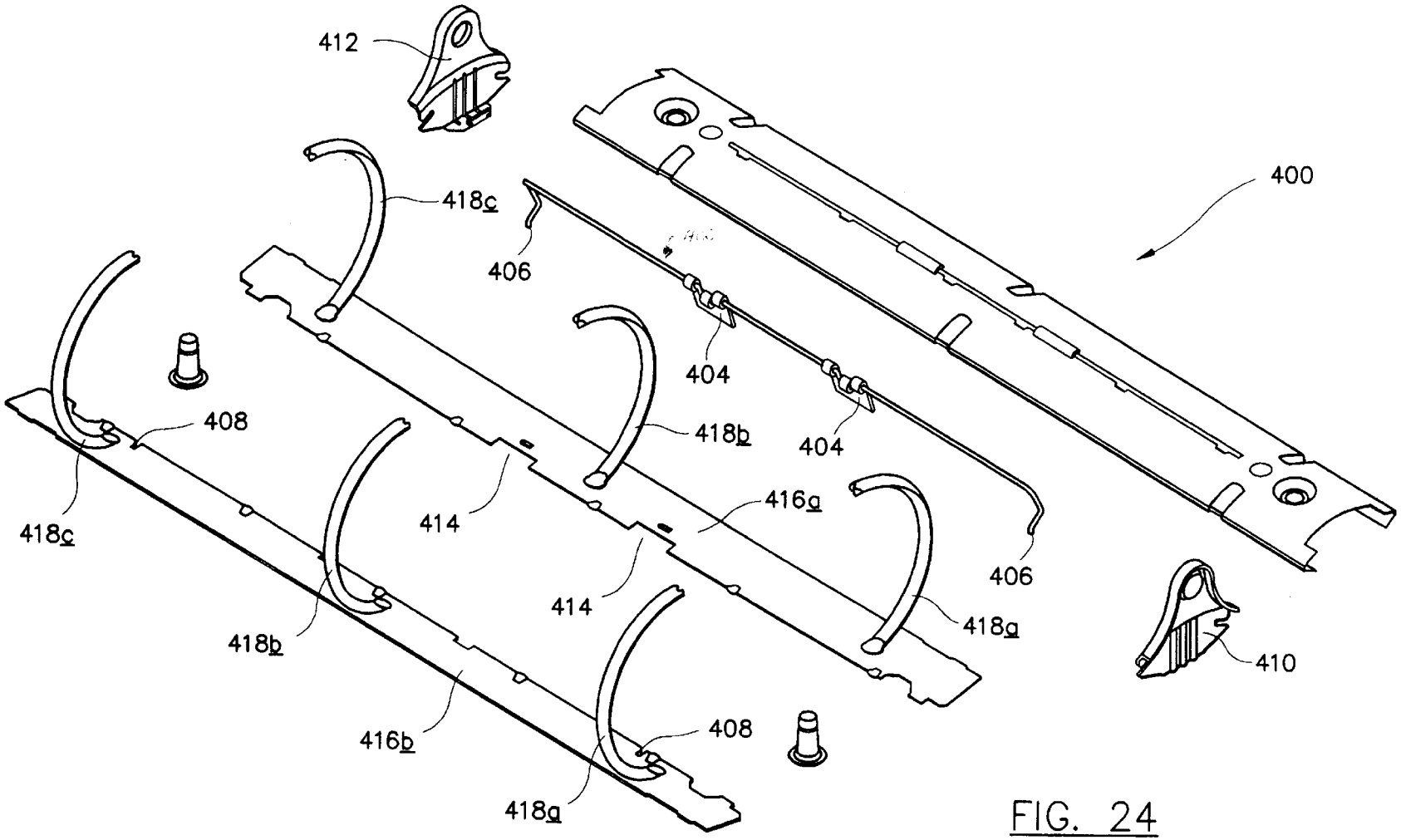
FIG. 24 shows an exploded view of the ring binder shown in FIG. 22.

In such an arrangement, the ring binder 300 can only be opened by firstly pivoting the lever 302 outward so that the ledge 312 acts on the under surface of the plates 308*a* and 308*b*. The half-rings 310*a* and 310*b* are then partly opened. The plate 308*b* will then act upon a bent portion 330 of the wire 318. The lock 316 will then be caused to rotate about the shaft 322 to move the lock elements 320 to disengage from the tongues 328 and the plate 308*b* to the position as shown in FIG. 20. In this position, the lock elements 320 are aligned with openings 332, so that the plates 308*a* and 308*b* can be fully pivoted and the half-rings 310*a*, 310*b* and 310*c* fully opened (as shown in FIG. 21) by subsequently pivoting the lever 304 outward. The ring binder 300 can be closed by pushing any of the pairs of half-rings 310*a*, 310*b* and 310*c* together. The half-rings 310*a*, 310*b* and 310*c* cannot, however, be opened by first pivoting the lever 304 outward, and subsequently the lever 302.

Figure 25:
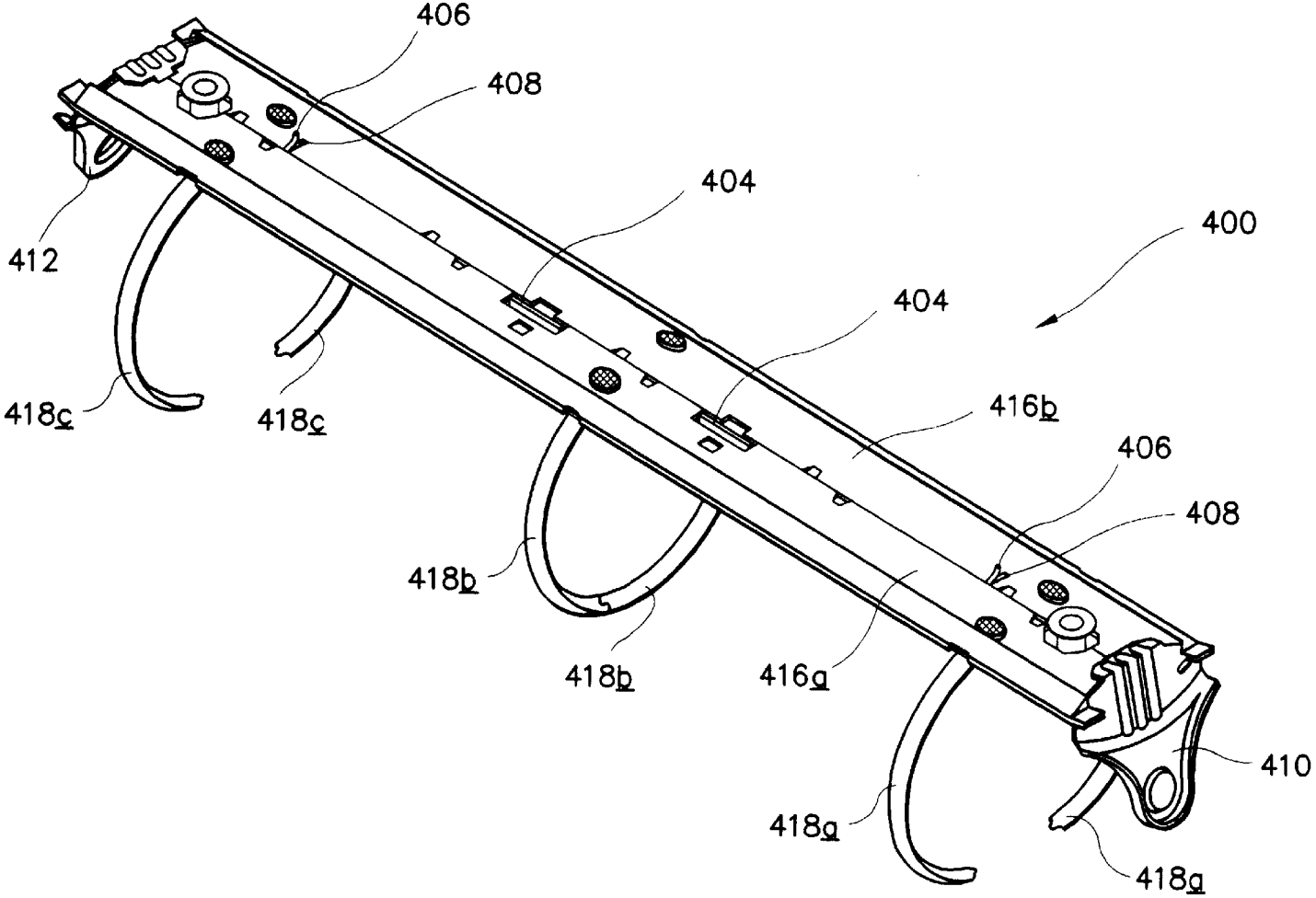
FIG. 25 shows a bottom perspective view of the ring binder shown in FIG. 22 with some of the half-rings partly opened.
Figure 26:
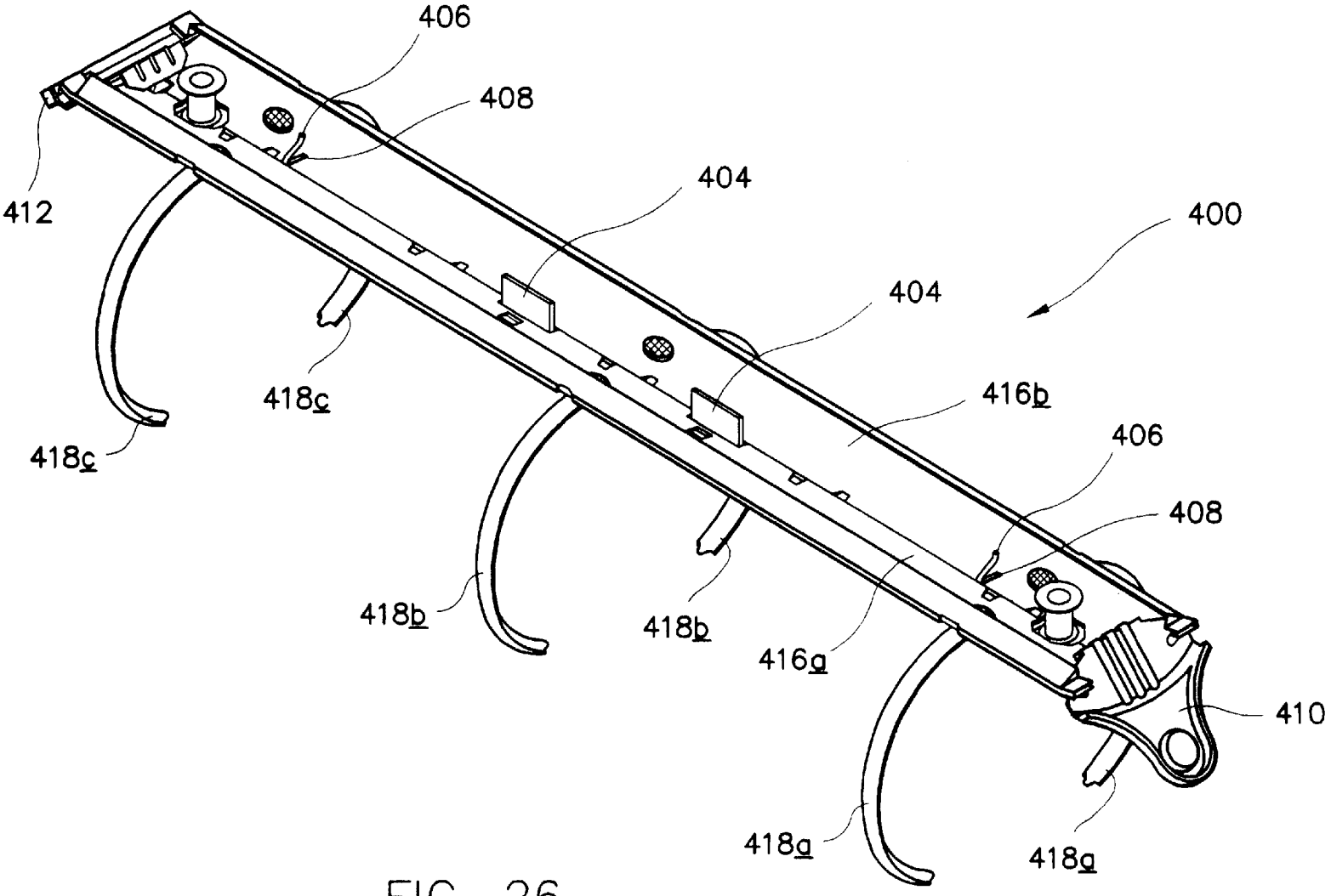
FIG. 26 shows a bottom perspective view of the ring binder shown in FIG. 22 with all the half-rings fully opened.

FIGS. 22 to 26 show a fifth embodiment of a ring binder according to the present invention generally designated as 400. A major difference between this embodiment and the fourth embodiment discussed above is that the ring binder 400 is provided with a lock 402 including two lock members 404 and two distal ends 406. Each of the distal ends 406 of the lock 402, when in the position shown in FIG. 23, extends slightly through an aperture 408. To open the ring binder 400, either of the levers 410 and 412 may be pivoted outwardly to position as shown in FIG. 25. In this position, the lock members 404 are aligned with openings 414, thus allowing plates 416*a* and 416*b* to pivot further, by further outward pivoting movement of the same lever 410 or 412, to open three pairs of half-rings 418*a*, 418*b* and 418*c* to the position as shown in FIG. 26. In this arrangement, the ring binder 400 cannot be opened by actioning upon any of the pairs of half-rings 418*a*, 418*b* and 418*c*.

It should be noted that the above only illustrates embodiments and examples in which the invention may be carried out, and that further modifications and/or alterations may be made to the examples without departing from the spirit of the invention.

I claim:

1. A ring binder comprising a substantially rigid upper structure;

a lower structure supported by said upper structure comprising a pair of plate members, said plate members being pivotally movable between a first position in which the angle between the upper surfaces of the plate members is less than 180°, and a second position in which the angle between the upper surfaces of the plate members is more than 180°;

a lock member to lock the lower structures; and an operating means to operate the lock member, wherein said lock member acts at a first location on the ring binder and said operating means acts at a second location on the ring binder, said first location being longitudinally distal on the ring binder from said second location.

2. A ring binder according to claim 1 wherein at least two pairs of half-ring members are mounted to the lower structure and said first location is adjacent a first pair of said half-ring members.

3. A ring binder according to claim 2 wherein said second location is adjacent a second pair of said half-ring members.

4. A ring binder according to claim 1 wherein said lock member is movable from a locked position in which it locks the lower structure against pivotal movement and an unlocked position in which the lower structure is pivotally movable.

5. A ring binder according to claim 4 wherein said ring binder further comprises actuating means indirectly movable by said operating means to move the lock member from the locked position to the unlocked position.

6. A ring binder according to claim 4 or 5 wherein said lock member, when in said locked position engages the upper surface of one of the plate members.

7. A ring binder according to claim 4 or 5 wherein at least part of said lock member, when in said unlocked position extends through an aperture means of said lower structure.

8. A ring binder according to claim 7 wherein at least part of the actuating means extends through the aperture means.

9. A ring binder according to claim 5 wherein said plate members pass through a common plane when they move from said first to said second position and vice versa and wherein said actuating means comprises an end portion inclining at an acute angle to the lower structure when said plate members are on said common plane.

10. A ring binder according to claim 5 wherein a first of the pair of plate members acts on a first side of the actuating means to unlock the lower structure.

11. A ring binder according to claim 5 wherein a second of the pair of plate members acts on a second side of the actuating means to lock the lower structure.

12. A ring binder according to claim 9 wherein said end portion is acutely inclined to a longitudinal axis of the ring binder.

13. A ring binder according to claim 7 wherein said aperture means comprises at least one edge angled to the longitudinal axis of the ring binder.

14. A ring binder according to claim 2 or 3 wherein said ring binder further comprises actuating means having at least one end portion and wherein said lower structure acts on said end portion during opening of the pairs of half-ring members.

15. A ring binder according to claim 2 or 3 wherein said ring binder further comprises actuating means having at least one end portion and wherein said lower structure acts on the end portion during closing of the pairs of half-ring members.

16. A ring binder according to claims 1, 2 or 3 wherein said lock member is swivellably movable relative the upper structure.

17. A ring binder according to claims 5 or 12 wherein said lock member is fixedly engaged with the actuating means.

18. A ring binder according to claim 1, 2 or 3 wherein said lock member comprises at least one platelet.

19. A ring binder according to claim 18 wherein said lock member comprises a plurality of platelets.

20. A ring binder according to claims 1, 2 or 3 wherein said operating means comprises at least one of the pairs of half-ring members.

21. A ring binder according to claim 20 wherein said pair of half-ring members are adjacent one longitudinal end of the ring binder.

22. A ring binder according to claim 20 wherein said operating means comprises a plurality of pairs of half-ring members.

23. A ring binder according to claim 20 wherein said operating means comprises two pairs of half-ring members each of which is adjacent a respective longitudinal end of the ring binder.

24. A ring binder according to any one of claims 1, 2 or 3 wherein said operating means comprises at least one lever member.

25. A ring binder according to claim 24 wherein said operating means comprises a plurality of lever members.

26. A ring binder according to claim 25 wherein said operating means comprises two lever members each at a respective longitudinal end of the ring binder.

27. A ring binder according to claim 24 wherein said lever member is pivotally movable to act on an under surface of the lower structure to move the actuating means to move the lock member from the locked position to the unlocked position.

28. A ring binder according to claim 26 wherein said lower structure is pivotally movable from its first position to its second position upon pivotal movement of firstly a first of said two lever members and subsequently of a second of said two lever members, and the lower structure is locked against pivotal movement from its first position to its second position upon pivotal movement firstly of the second of said two lever members and subsequently of the first of said two lever members.

29. A ring binder according to claim 26 wherein said lower structure is pivotally movable from its first position to its second position upon pivotal movement of either of the two lever members.

* * * * *